US011391088B2

(12) United States Patent
McKee

(10) Patent No.: US 11,391,088 B2
(45) Date of Patent: Jul. 19, 2022

(54) ROLLER BLIND ASSEMBLY

(71) Applicant: Joseph S. McKee, Miami, FL (US)

(72) Inventor: Joseph S. McKee, Miami, FL (US)

( * ) Notice: Subject to any disclaimer, the term of this patent is extended or adjusted under 35 U.S.C. 154(b) by 499 days.

(21) Appl. No.: 16/381,040

(22) Filed: Apr. 11, 2019

(65) Prior Publication Data

US 2020/0325724 A1 Oct. 15, 2020

(51) Int. Cl.

| | |
|---|---|
| ***E06B 9/24*** | (2006.01) |
| ***E06B 9/42*** | (2006.01) |
| ***E06B 9/70*** | (2006.01) |
| ***E06B 9/58*** | (2006.01) |
| ***E06B 9/78*** | (2006.01) |
| ***E06B 9/74*** | (2006.01) |
| *E06B 9/68* | (2006.01) |

(52) U.S. Cl.

CPC ..... *E06B 9/42* (2013.01); *E06B 9/58* (2013.01); *E06B 9/70* (2013.01); *E06B 9/74* (2013.01); *E06B 9/78* (2013.01); *E06B 2009/2494* (2013.01); *E06B 2009/6809* (2013.01); *E06B 2009/785* (2013.01)

(58) Field of Classification Search

CPC ..... E06B 2009/2494; E06B 9/42; E06B 9/58; E06B 9/70; E06B 9/74; E06B 9/78; E06B 9/6809; E06B 2009/785; E06B 209/2482; E06B 9/40; B60J 1/2083; B60J 1/2086; B60J 1/2025; B60J 1/2072; B60J 1/2013; B60J 1/2041; B60J 1/2063; B60J 1/208

See application file for complete search history.

(56) References Cited

U.S. PATENT DOCUMENTS

| | | | | |
|---|---|---|---|---|
| 7,934,764 | B2 * | 5/2011 | Hansen | B60J 1/2072 296/97.8 |
| 8,960,261 | B1 * | 2/2015 | Williams | B60J 1/2025 160/370.22 |
| 10,570,662 | B2 * | 2/2020 | Miroshnichenko | A47H 15/02 |
| 2008/0223534 | A1 * | 9/2008 | Hansen | B60J 1/2086 160/370.22 |
| 2013/0255892 | A1 * | 10/2013 | Ojima | B60J 1/2022 160/266 |
| 2014/0318048 | A1 * | 10/2014 | Dison | E06B 9/24 52/203 |

FOREIGN PATENT DOCUMENTS

| | | | | |
|---|---|---|---|---|
| DE | 3225099 A | * | 9/1983 | E06B 9/24 |
| DE | 3508254 A1 | * | 9/1986 | E06B 9/24 |
| DE | 4111400 C | * | 8/1992 | E06B 9/40 |

* cited by examiner

*Primary Examiner* — Johnnie A. Shablack
*Assistant Examiner* — Jeremy C Ramsey
(74) *Attorney, Agent, or Firm* — Charlena Thorpe, Esq.; Incorporating Innovation LLC

(57) ABSTRACT

Implementations of a roller blind assembly for angled architectural openings are provided. In some implementations, the roller blind assembly comprises a frame, a roller tube assembly, a roller blind sheet, a chain assembly, a track assembly, an extension assembly, a retraction assembly, and a motor assembly.

In some implementations, a method of using the roller blind assembly comprises installing the roller blind assembly to fully fit the perimeter of an angled architectural opening and operating the roller blind assembly to fully cover the opening of the angled architectural opening.

13 Claims, 21 Drawing Sheets

ROLLER BLIND ASSEMBLY

TECHNICAL FIELD

This disclosure relates to implementations of a roller blind assembly for angled architectural openings.

BACKGROUND

Roller blinds are used to cover architectural openings, such as windows of a house, office building, or other structure. The roller blinds are used to provide shading, privacy, and/or other preferences by covering the architectural openings.

Roller blinds are designed to fit architectural openings by fitting around the perimeter or within the frame of the architectural openings. Roller blinds are designed to cover architectural openings by extending to fully cover the architectural openings. The roller blinds are also designed to retract to uncover the architectural openings.

Roller blinds include a roller and a sheet element. One end of the sheet element is attached to the roller. The sheet element rolls up around the roller when the roller blind is retracted. The sheet element unwinds and extends from the roller when the roller blind is extended. The sheet element is composed of a thin flexible material, such as fabric or plastic.

The roller of existing roller blinds is mounted at the top side of an architectural opening. Gravity assists to extend the sheet element downward as the sheet element is unwound from the roller. Gravity also assists to keep the unwound sheet element extended downward over the architectural opening. Thus, the weight of the sheet element, and in some designs an added weighting near the bottom end of the sheet element, is all that keeps the thin flexible sheet element extended over the architectural opening.

Existing roller blinds are rectangular shaped. Therefore, existing roller blinds are only able to fully fit and cover, as described above, rectangular shaped architectural openings. However, some architectural openings have a modified rectangular shape in which one side, such as the top or bottom side, of the architectural openings is angled so that this angled side is not parallel or perpendicular to the other sides. These architectural openings can be referred to as angled architectural openings.

Existing roller blinds are not able to fully fit and cover angled architectural openings, particularly when the angled side is at the top or bottom of the angled architectural openings. Furthermore, existing roller blinds can only properly extend and retract to fit and cover architectural openings when the roller is mounted at the top side of the architectural openings so that the sheet material extends vertically downward from the roller as described above. Therefore, existing roller blinds can not properly extend and retract to fit and cover architectural openings if the roller is mounted at the left or right side of the architectural openings so that the sheet material has to extend horizontally, such as to fit and cover angled architectural openings that have an angled top or bottom side.

DETAILED DESCRIPTION

Implementations of a roller blind assembly for angled architectural openings are provided. In some implementations, the roller blind assembly comprises a frame, a roller tube assembly, a roller blind sheet, a chain assembly, a track assembly, an extension assembly, a retraction assembly, and a motor assembly.

In some implementations, the roller blind assembly is configured to fully fit the perimeter of and also fully cover the opening of angled architectural openings.

In some implementations, the roller blind assembly is configured to extend, retract, and maintain the extension of a non-vertical roller blind such as a horizontally extending roller blind.

In some implementations, a method of using the roller blind assembly comprises installing the roller blind assembly to fully fit the perimeter of an angled architectural opening. In some implementations, the method comprises operating the roller blind assembly to fully cover the opening of the angled architectural opening.

Figure 1A:
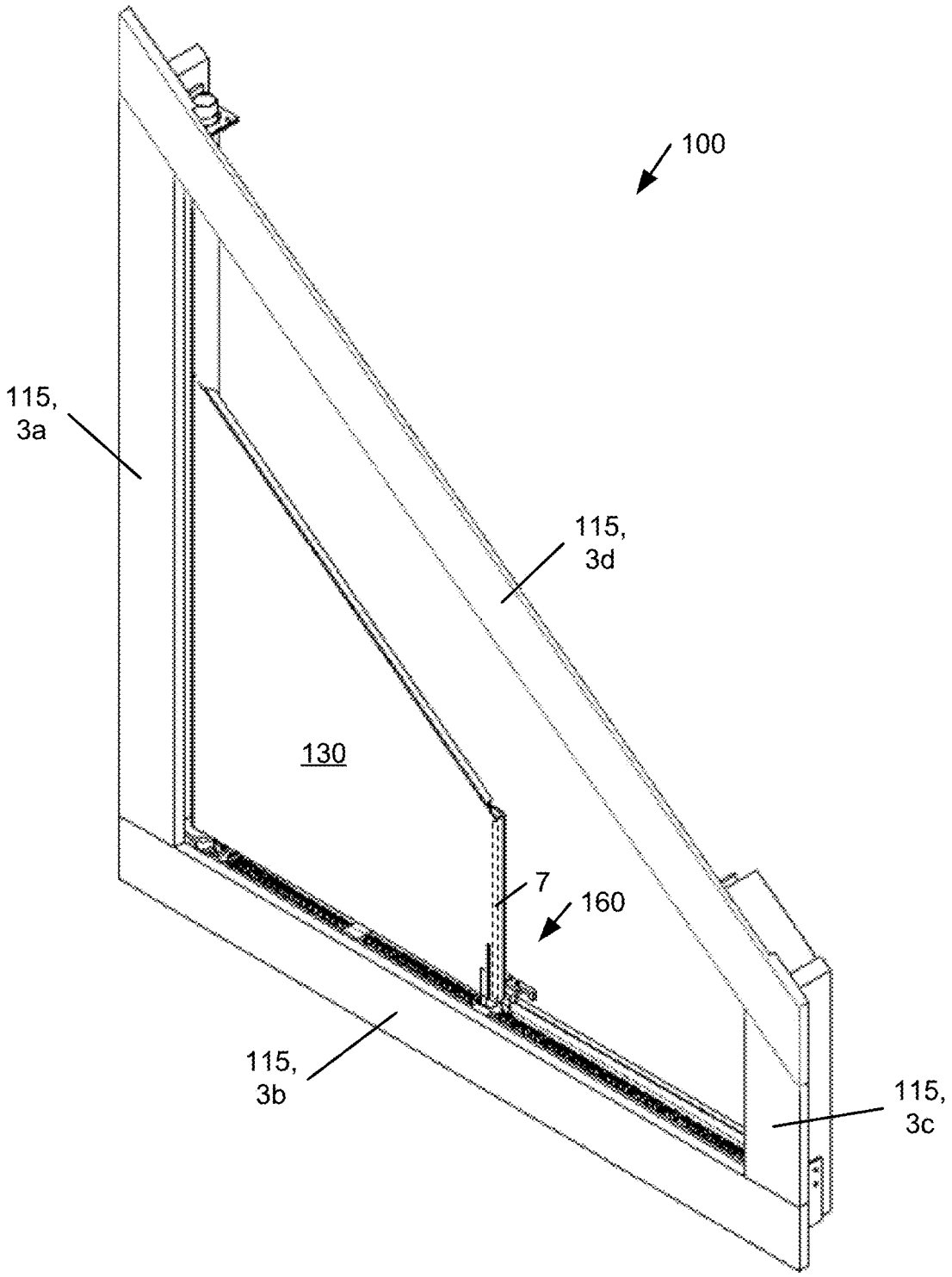
FIG. 1*a* illustrates a front side or interior side perspective view of an implementation of an example roller blind assembly according to the present disclosure with the roller blind sheet partially extended or retracted.
Figure 1B:
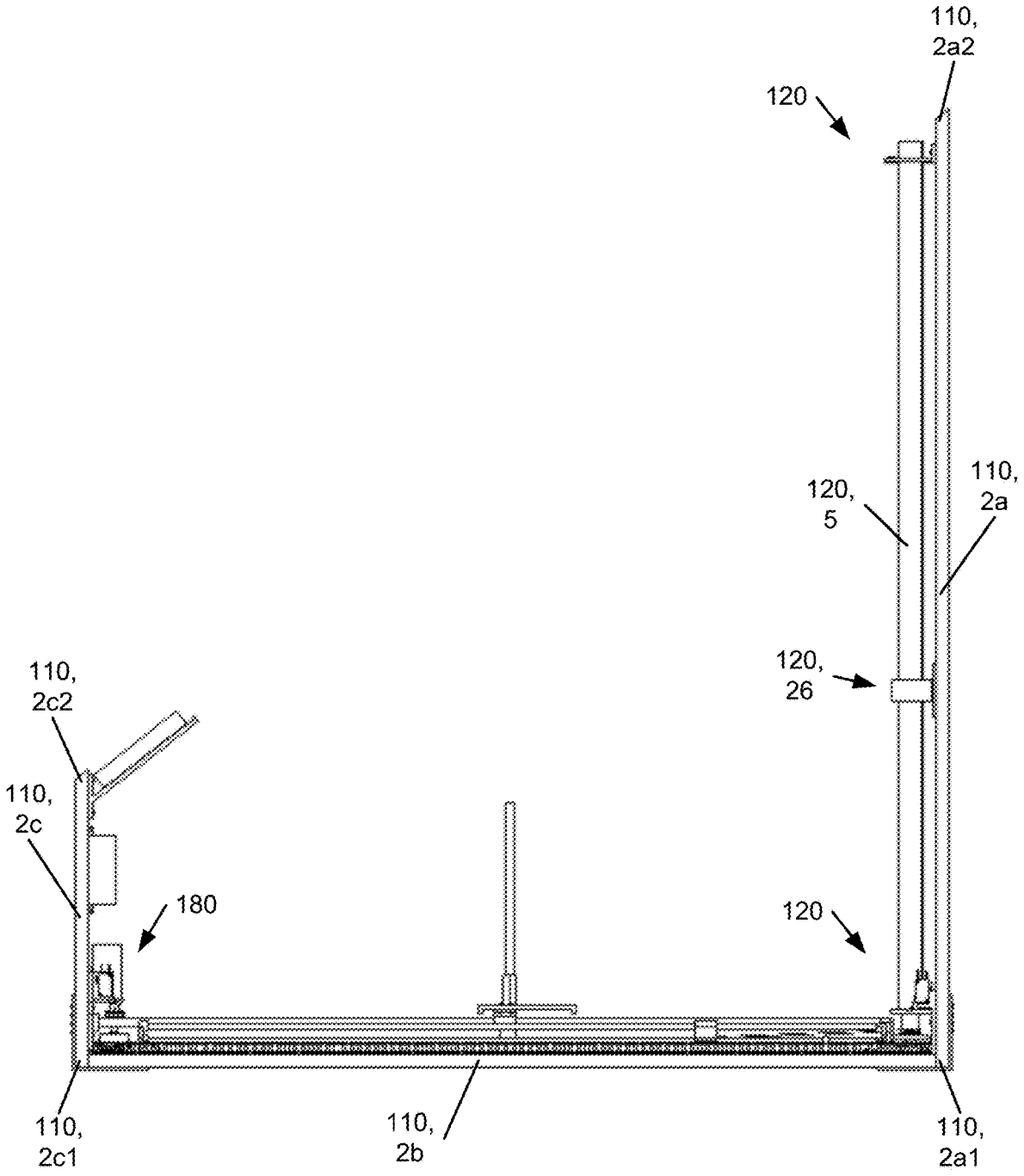
FIG. 1*b* illustrates a back side or exterior side view of the frame and other components of the roller blind assembly according to the present disclosure.
Figure 1C:
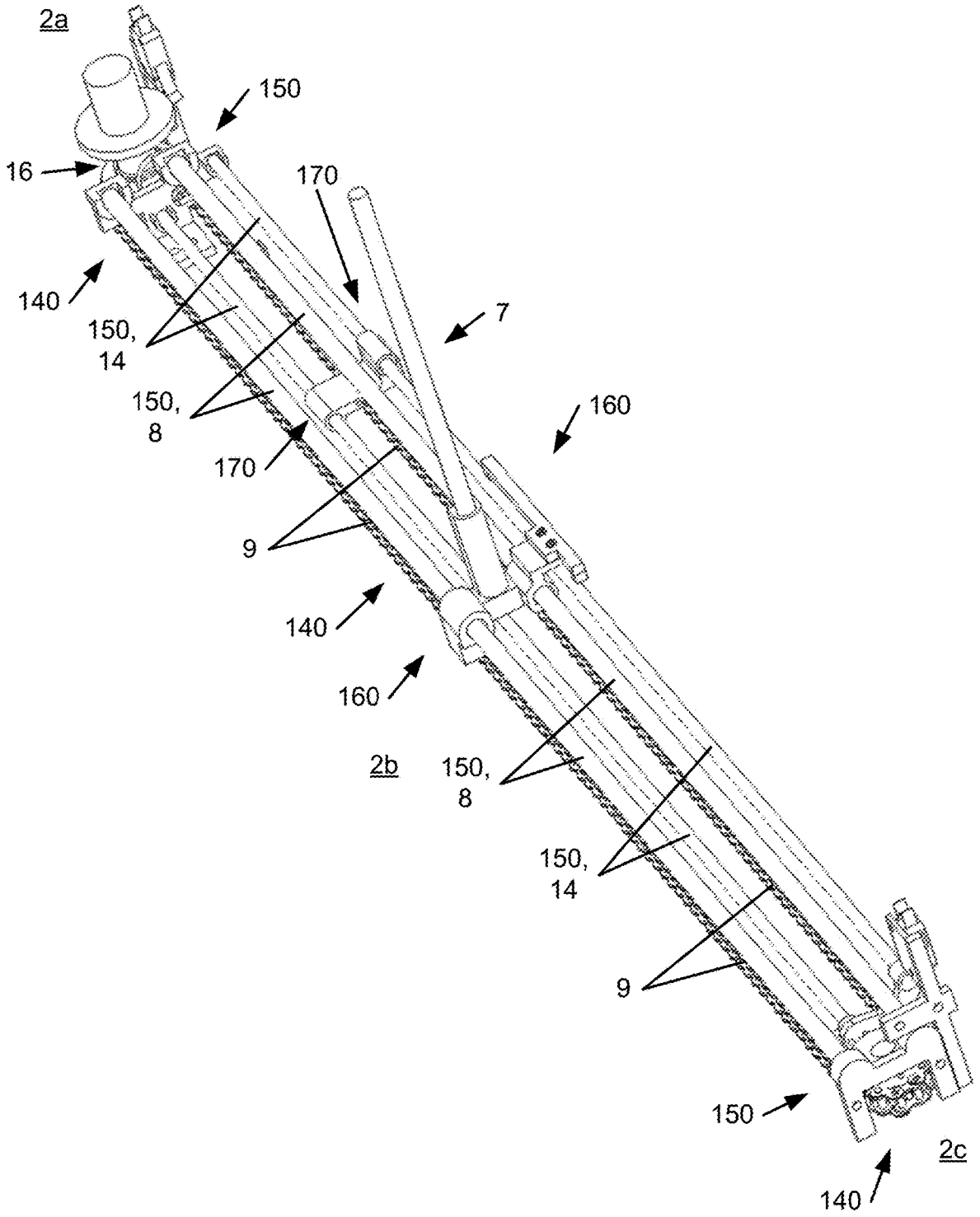
FIG. 1*c* illustrates a top side perspective view of the track assembly and other components of the roller blind assembly according to the present disclosure.

As shown in FIGS. 1*a*-1*c*, in some implementations, the roller blind assembly 100 comprises a frame 110, a roller tube assembly 120, a roller blind sheet 130, a chain assembly 140, a track assembly 150, an extension assembly 160, a retraction assembly 170, and a motor assembly 180.

In some implementations, the roller blind assembly 100 can fully fit the perimeter of a window having a modified rectangular shape. In some implementations, the roller blind assembly 100 can also fully cover the opening of the window having the modified rectangular shape.

In some implementations, the top side of the window having the modified rectangular shape extends diagonally downward from a first (e.g., left) side to a second (e.g., right) side of the window. In some implementations, the top side of the window is non-perpendicular to the first side and the second side of the window. In some implementations, the top side of the window is non-parallel to the bottom side of the window.

In some implementations, the foregoing features of the top side of the window can be switched to the bottom side of the window so that the bottom side of the window is "angled" instead of the top side.

Figure 19:
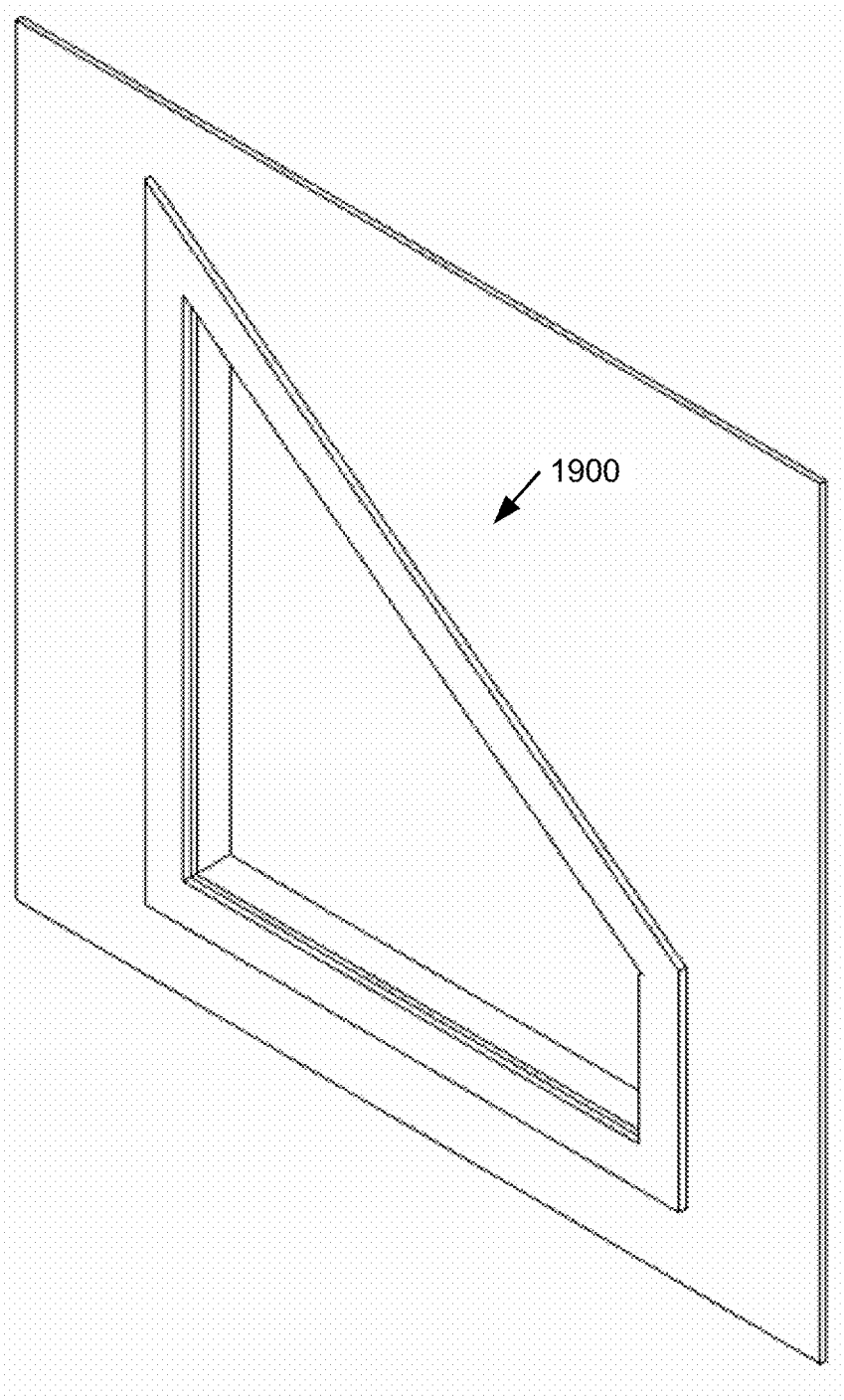
FIG. 19 illustrates a front side or interior side perspective view of an example angled architectural opening.

In some implementations, the above described window is an example of an angled architectural opening as referred to herein this description. In some implementations, an angled architectural opening as referred to herein is an architectural opening, such as a window (or window opening) of a house, office building, or other structure, that has a modified rectangular shape in which one side, such as the top or bottom side, is angled so that this angled side is not parallel or perpendicular to the other sides. In this regard, FIG. 19 illustrates a front side or interior side perspective view of an example angled architectural opening 1900.

As shown in FIG. 1*b*, in some implementations, the frame 110 comprises a first (e.g., left) side 2*a*, a bottom side 2*b*, and a second (e.g., right) side 2*c*. In some implementations, the first side 2*a* comprises a first side bottom end 2*a*1 and a first side top end 2*a*2. In some implementations, the second side 2*c* comprises a second side bottom end 2*c*1 and a second side top end 2*c*2.

In some implementations, the first side 2*a* extends vertically between the first side bottom end 2*a*1 and the first side top end 2*a*2. In some implementations, the second side 2*c* extends vertically between the second side bottom end 2*c*1 and the second side top end 2*c*2.

In some implementations, the bottom side 2*b* extends horizontally between and is connected respectively to the first side bottom end 2*a*1 and the second side bottom end 2*c*1.

In some implementations, the frame 110 may further comprise a top side (not shown) that extends between the first side top end 2*a*2 and the second side top end 2*c*2.

In some implementations, the first side 2*a* is longer than the second side 2*c*.

In some implementations, the combination of the first side 2*a*, the bottom side 2*b*, and the second side 2*c* corresponds to the modified rectangular shape of the window so that the frame 110 can fully fit within or adjacent to the perimeter of the window.

For example, in some implementations, the shape of the frame 110 defined by the sides 2*a*, 2*b*, 2*c* corresponds to the modified rectangular shape of the window by the first side 2*a* of the frame 110 extending parallel to the first side of the window, the second side 2*c* of the frame 110 extending parallel to the second side of the window, and the bottom side 2*b* of the frame 110 extending parallel to the bottom side of the window.

In some implementations, the frame 110 is sized to fit within or adjacent to an existing frame of any other suitable angled architectural opening.

As shown in FIGS. 1*a* and 1*b*, in some implementations, as described below, the roller tube assembly 120, the chain assembly 140, the track assembly 150, and the motor assembly 180 are attached to the frame 110 within an interior of the frame 110. In some implementations, the interior of the frame 110 extends between the first side 2*a*, the bottom side 2*b*, and the second side 2*c* of the frame 110.

In some implementations, other components of the roller blind assembly 100 may also be attached within the interior of the frame 110.

Figure 4:
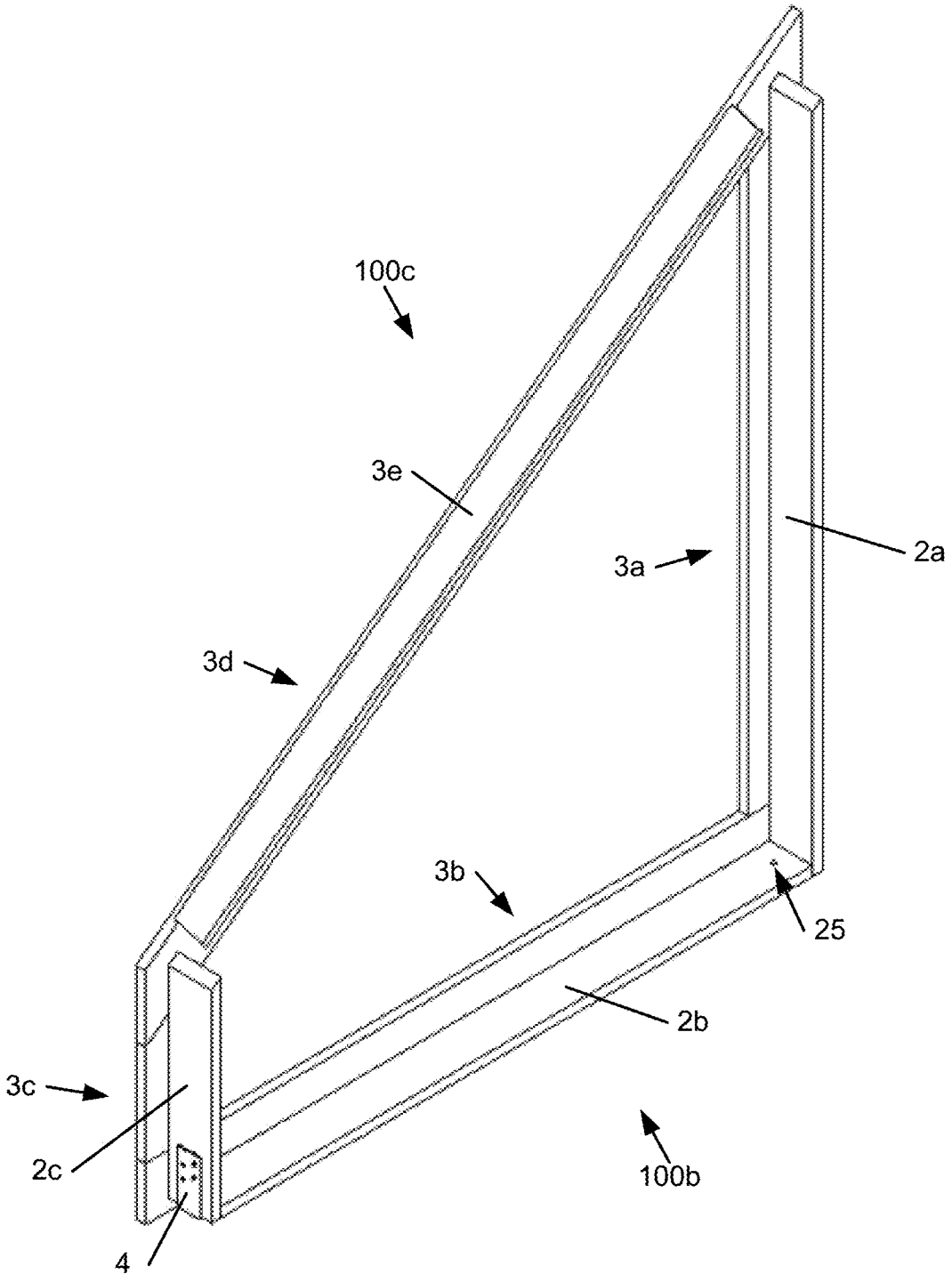
FIG. 4 illustrates a back side or exterior side perspective view of the frame and the outer frame of the roller blind assembly according to the present disclosure.
Figure 5:
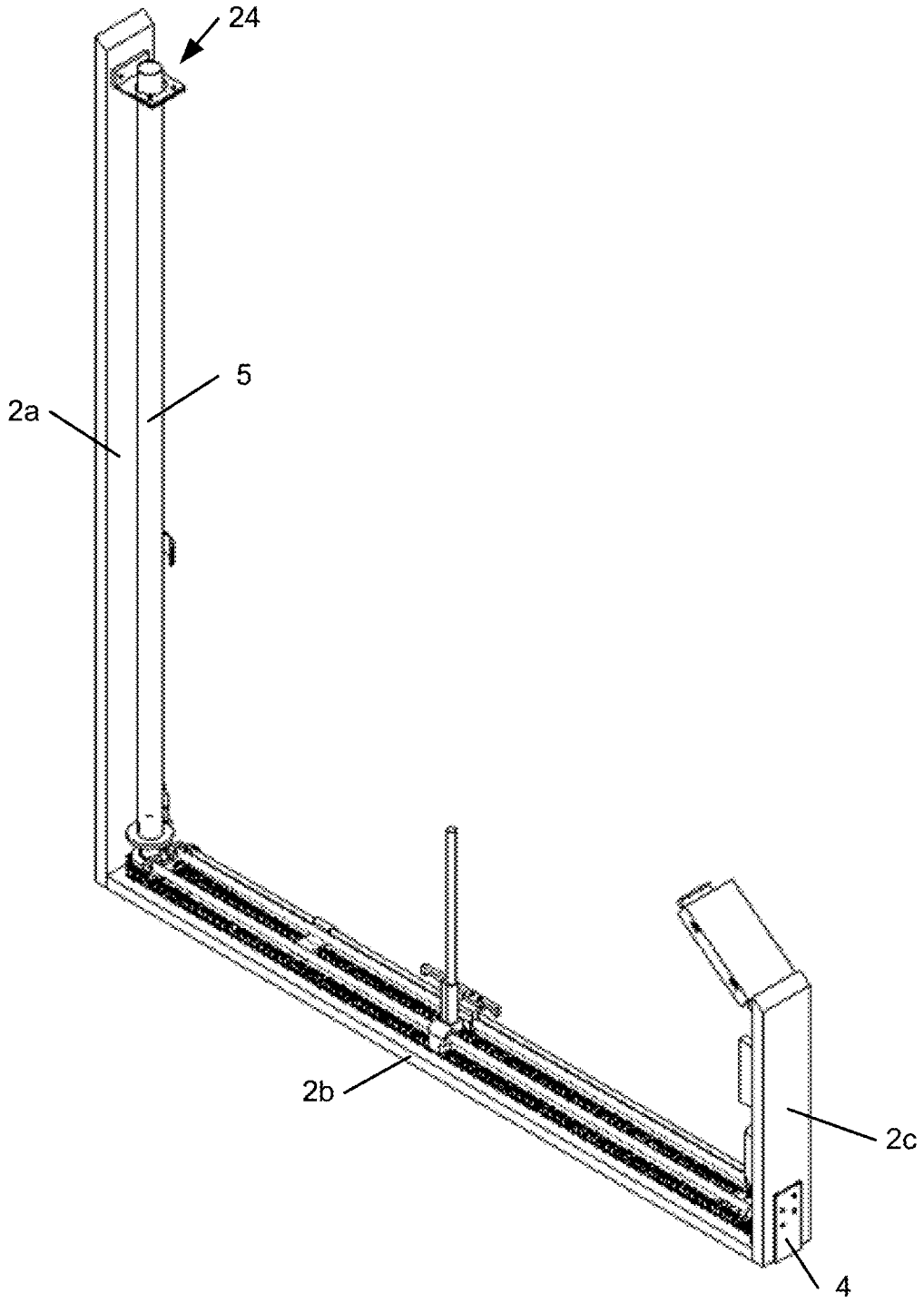
FIG. 5 illustrates a front side or interior side view of the frame and other components of the roller blind assembly according to the present disclosure.

As shown in FIGS. 4 and 5, in some implementations, the first side 2*a*, the bottom side 2*b*, and the second side 2*c* of the frame 110 are each at least partially or substantially rectangular beam shaped. In some implementations, the sides 2*a*, 2*b*, 2*c* can be any other suitable shape.

Figure 6:
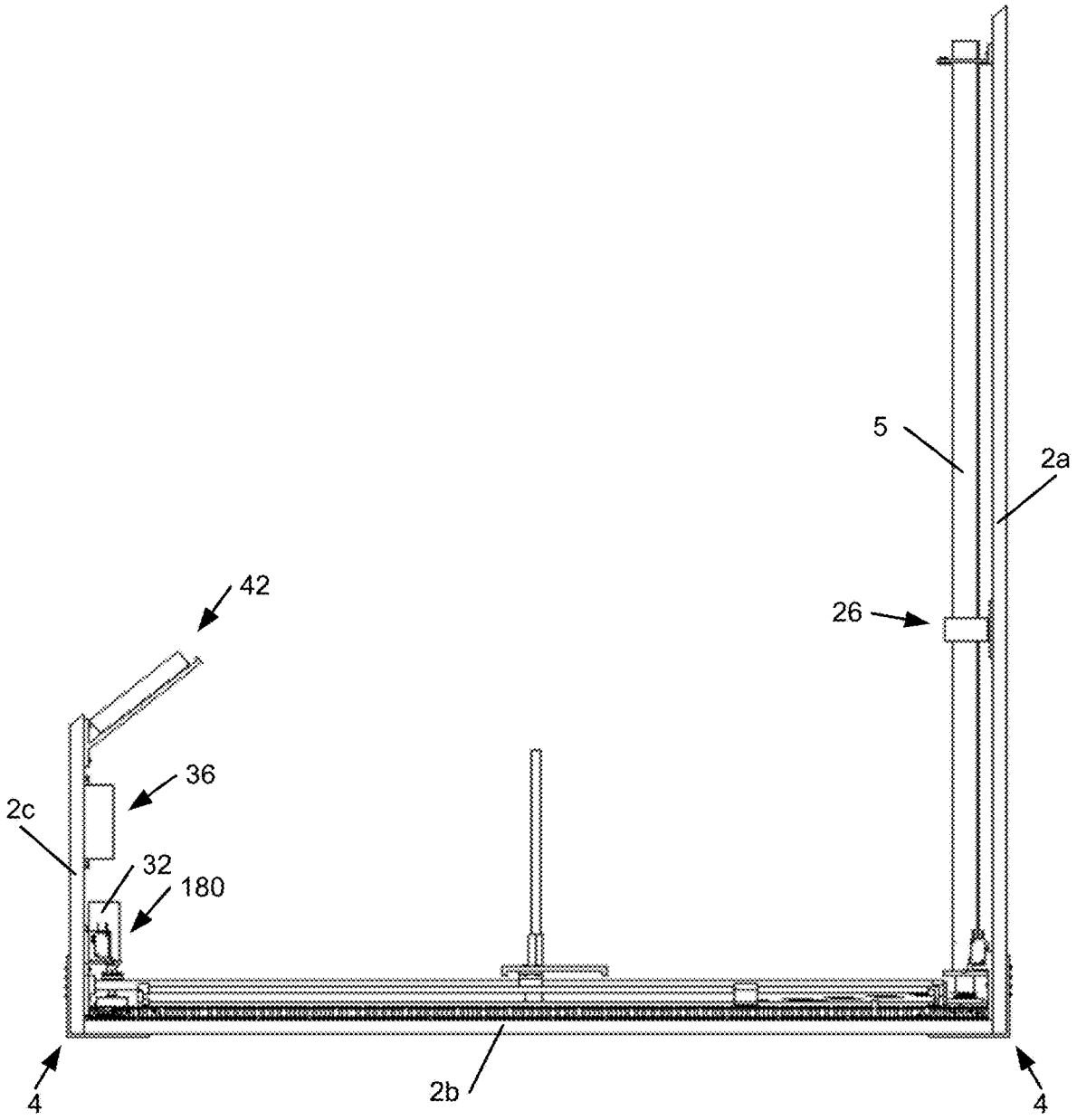
FIG. 6 illustrates another back side or exterior side view of the frame and other components of the roller blind assembly according to the present disclosure.

As shown in FIGS. 4-6, in some implementations, hardware angle brackets 4 may be used to maintain the shape of the frame 110. In some implementations, the brackets 4 may be used to connect the first frame side 2*a* and the bottom frame side 2*b*. In some implementations, the brackets 4 may be used to connect the bottom frame side 2*b* and the second frame side 2*c*.

In some implementations, the brackets 4 may be connected to the frame sides 2*a*, 2*b*, 2*c* with screws or similar fasteners. In some implementations, the screws may be long enough to help maintain a solid structural shape of the frame sides 2*a*, 2*b*, 2*c*. In some implementations, the screws may not extend all of the way through the frame sides 2*a*, 2*b*, 2*c* and therefore may not be exposed in a top view of the frame 110.

In some implementations, alternate references may be used herein with respect to the frame sides 2*a*, 2*b*, 2*c*, or similar elements, such as retracted side 2*a* and extended side 2*c*. However, it should be understood that such references refer to the same respective elements or other relative aspects based on the same reference number used. For example, in some implementations described herein, the first side 2*a* and the retracted side 2*a* refer to the same element.

Furthermore, retracted side or similar retracted references refer to the side on which the roller blind sheet 130, described below, approaches or positions when fully retracted, e.g. the frame first side 2*a* with respect to the disclosure herein. Similarly, extended side or similar extended references refer to the side on which the roller blind sheet 130 approaches or positions when fully extended, e.g. the frame second side 2*c* with respect to the disclosure herein.

As shown in FIG. 1*a*, in some implementations, the roller blind assembly 100 further comprises an outer molding or "outer frame" 115. In some implementations, the outer frame 115 comprises an outer first (e.g., left) side 3*a*, an outer second side 3*c*, an outer top side 3*d*, and an outer bottom side 3*b*.

In some implementations, the combination of the sides 3*a*, 3*b*, 3*c*, 3*d* of the outer frame 115 form a modified rectangular shape. In some implementations, the modified rectangular shape is substantially congruent in length along each side to the length along each corresponding side 2*a*, 2*b*, 2*c* of the frame 110 of the roller blind assembly 100.

For example, in some implementations, the sides 3*a*, 3*b*, 3*c*, 3*d* are connected together respectively to form a modified rectangular shape so that the outer first side 3*a* extends parallel and congruent in length with the first side 2*a* of the frame 110, the outer second side 3*c* extends parallel and congruent in length with the second side 2*c* of the frame 110, and the outer bottom side 3*b* extends parallel and congruent in length with the bottom side 2*b* of the frame 110.

In some implementations, the outer frame 115 is attached to the frame 110 along each corresponding side 2*a*, 2*b*, 2*c* of the frame 110 respectively.

For example, in some implementations, the outer frame 115 is attached to the frame 110 so that the outer first side 3*a* is adjacent to the first side 2*a* of the frame 110, the outer second side 3*c* is adjacent to the second side 2*c* of the frame 110, and the outer bottom side 3*b* is adjacent to the bottom side 2*b* of the frame 110.

In some implementations, the outer frame 115 at least partially conceals the other components of the roller blind assembly 100 that are attached or adjacent to the frame 110. As shown in FIG. 1*a*, in some implementations, the outer frame 115 at least partially conceals the other components when the roller blind assembly 100 is viewed toward the direction in which the outer frame 115 is attached to the frame 110.

Figure 3:
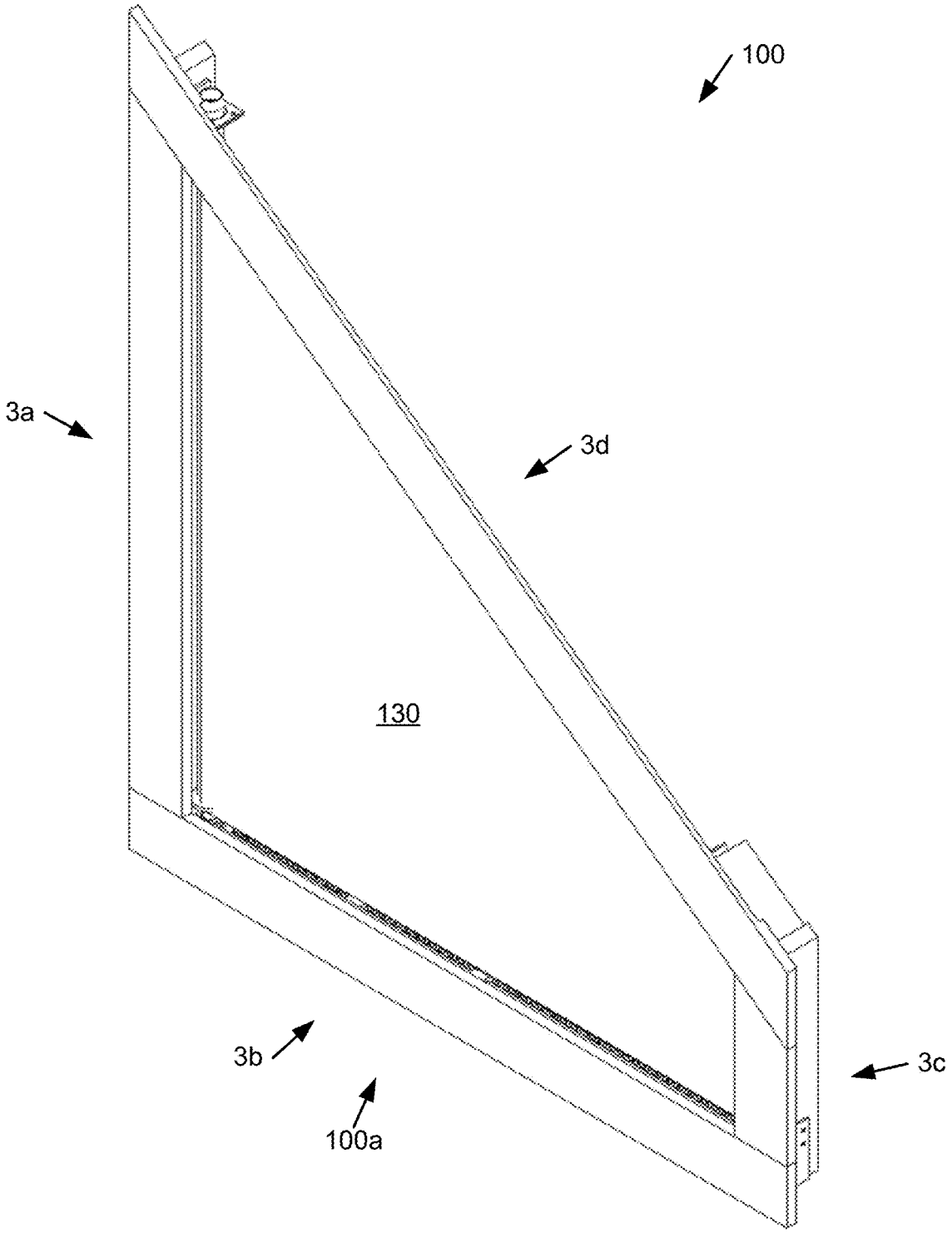
FIG. 3 illustrates another front side or interior side perspective view of the roller blind assembly according to the present disclosure with the roller blind sheet fully extended.

As shown in FIGS. 3 and 4, in some implementations, the outer frame sides 3*a*, 3*b*, 3*c*, 3*d* minimize the visibility of components of the roller blind assembly 100 from a viewer on the interior side 100*a* of the assembly 100. In some implementations, the outer frame sides 3*a*, 3*b*, 3*c*, 3*d* provides for a transition between the roller blind assembly 100 and existing framework or molding around an angled architectural opening.

In some implementations, the materials, decorative design, staining or painting colors, and/or sheen of the outer frame sides 3*a*, 3*b*, 3*c*, 3*d* can be modified to match or complement the existing framework or molding of the angled architectural opening.

In some implementations, the sizing of the outer frame sides 3*a*, 3*b*, 3*c*, 3*d* is based on the amount of coverage required to minimize the visibility of the assembly 100 components from an interior viewpoint. In some implementations, the sizing of the outer frame sides 3*a*, 3*b*, 3*c*, 3*d* is based on the desired amount of molding for a transition to the existing framework or molding on the angled architectural opening.

In some implementations, the top outer frame side 3*d* also provides a path for heat to escape from the exterior side 100*b* of the roller blind assembly 100 out of the top side 100*c* of the assembly 100. As shown in FIG. 4, in some implementations, a cutout 3*e* is cut in the top outer frame side 3*d* to provide this path.

In some implementations, the cutout 3*e* runs most or all of the length of a top portion of the top outer frame side 3*d*. In some implementations, the cutout 3*e* runs from the very top of the top outer frame side 3*d* down to a point below the top framework or molding of the angled architectural opening (not shown).

In some implementations, heat that builds on the exterior side 100*b* of the roller blind sheet 130 rises toward the top side 100*c* of the roller blind assembly 100. In some implementations, when the heat rises to the existing molding or framework of the angled architectural opening, the heat can escape through the cutout 3*e* and out of the top side 100*c* of the assembly 100.

In some implementations, the heat can escape since the cutout 3*e* is cut to a point below the point of contact between the top outer frame side 3*d* and the existing molding or framework of the angled architectural opening. In some implementations, this flow path of heat through the cutout 3*e* minimizes the potential for damage caused by heat or the expansion of gasses to any material used to separate the interior from the exterior of the angled architectural opening, such as glass.

As introduced above, in some implementations, the frame 110 may further comprise a top side (not shown). In some implementations, such added top side includes a sufficient ventilation path for the escape of heat out of the top of the roller blind assembly 100.

In some implementations, this ventilation flow path is aligned with the cutout 3*e* in the optional outer frame 115 of the assembly 100. In some implementations, the ventilation flow path allows heat and heated gasses to escape from the exterior side 100*b* of the roller blind sheet 130 as described in the foregoing.

In some implementations, the roller blind assembly 100 may be rotated bottom side 2*b* up for use in an angled architectural opening with an angled bottom side instead of an angled top side. In some implementations, for such rotated assembly 100, the cutout 3*e* is repositioned on the bottom outer frame side 3*b* instead of the top outer frame side 3*d*.

In some implementations, the repositioned cutout 3*e* is started from above the point where the bottom outer frame side 3*b* meets the bottom frame side 2*b*. In some implementations, this change in the design of the cutout 3*e* allows for the escape of heat and gases from the exterior side of the roller blind sheet 130 for such rotated assembly 100.

As shown in FIG. 1*b*, in some implementations, the roller tube assembly 120 comprises a cylindrical tube 5. In some implementations, the roller tube assembly 120 is attached to the frame 110.

In some implementations, the tube 5 extends vertically adjacent to the first side 2*a* of the frame 110. In some implementations, the tube 5 is rotatably attached to the frame 110. In some implementations, the tube 5 is rotatable about the longitudinal center of the tube 5.

As shown in FIGS. 5 and 6, in some implementations, the roller tube 5 may be a hollow tube or pipe. In some implementations, the roller tube 5 may be cut slightly longer than the height of the roller blind sheet 130. In some implementations, the roller tube 5 is cut to allow for a place where the roller tube top bracket 24 can maintain the position of the roller tube 5 without interfering with the roller blind sheet 130.

In some implementations, the roller tube 5 can be a solid bar that is modified at the bottom side to accept the roller tube bottom attachment 22, described below.

In some implementations, the roller tube 5 is held in place in a vertical alignment. In some implementations, the roller tube 5 is held along the frame retracted side 2*a* of the roller blind assembly 100. In some implementations, the bottom side of the roller tube 5 is connected to a roller tube bottom attachment 22.

Figure 7A:
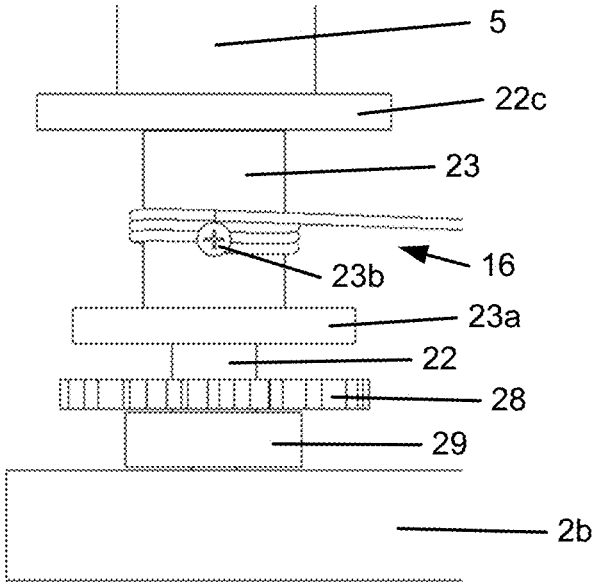
FIGS. 7*a* and 7*b* illustrate a side view and a corresponding exploded perspective view respectively of a bottom portion of the roller tube assembly of the roller blind assembly according to the present disclosure.
Figure 7B:
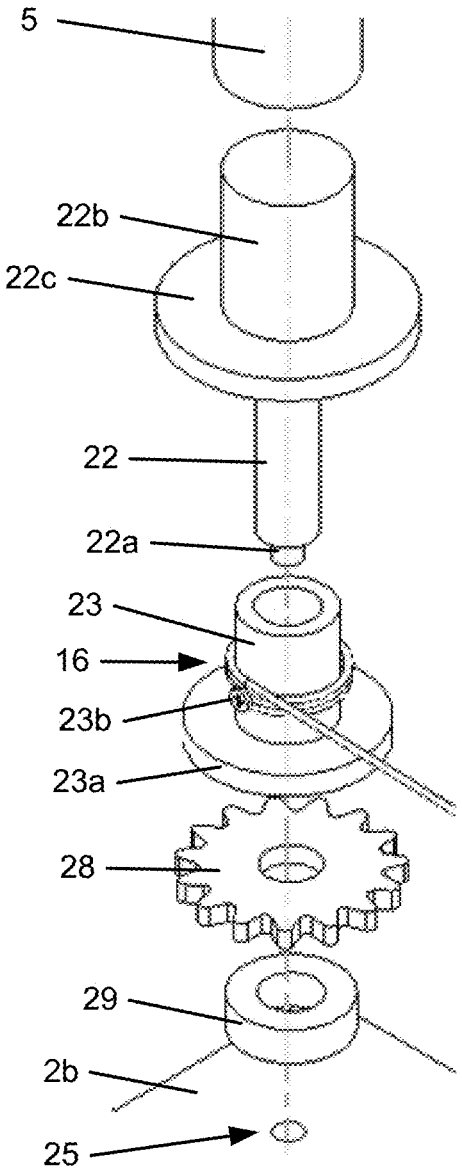

As shown in FIGS. 7*a* and 7*b*, in some implementations, the bottom attachment 22 sits in a hole 25. In some implementations, the hole 25 is drilled into the frame bottom side 2*b* of the roller blind assembly 100.

In some implementations, instead of the hole 25, an additional bracket (not shown) can be used to house the bottom attachment 22 to hold the attachment 22 in place. In some implementations, this bracket can be connected to the frame bottom side 2*b* in many ways, such as by screw(s) or adhesive.

In some implementations, the hole 25 is large enough to allow the roller tube bottom attachment 22 to rotate freely about an axis that runs from the bottom to the top of the roller blind assembly 100. In some implementations, the hole 25 is tight enough to minimize movement of the bottom attachment 22 away from the hole 25.

As shown in FIG. 4, in some implementations, the hole 25 is positioned at a distance from the frame retracted side 2*a*. In some implementations, the hole 25 is positioned at a far enough distance to prevent the frame retracted side 2*a* from interfering with the roller blind sheet 130 when coiled around the roller tube 5. In some implementations, the hole 25 is positioned close enough to the frame retracted side 2*a* to maximize the view through the angled architectural opening when the roller blind sheet 130 is fully retracted.

In some implementations, the hole 25 is positioned to prevent the roller tube 5, roller blind sheet 130, bottom attachment 22, or top bracket 24, described below, from interfering with the original material inside the angled architectural opening, such as glass. In some implementations, the hole 25 is positioned to prevent the foregoing components from interfering with the outer frame sides 3*a*, 3*b* if included in the assembly 100.

As shown in FIG. 7*b*, in some implementations, the bottom portion 22*a* of the roller tube bottom attachment 22 is narrowed to fit into the hole 25. In some implementations, the bottom portion 22*a* of the bottom attachment 22 is narrowed to minimize unnecessary friction between the bottom attachment 22 and the frame bottom side 2*b*.

In some implementations, the hole 25 is deep enough to securely hold the roller tube bottom attachment 22 in place. In some implementations, the hole 25 is not so deep that the bottom portion 22*a* of the bottom attachment 22 is floating inside the hole 25.

In some implementations, the attachment bottom portion 22*a* rests on the bottom of the hole 25. In some implementations, the bottom portion 22*a* provides sufficient vertical force along the roller tube 5 to provide bottom support of the roller tube 5.

As shown in FIG. 7*b*, in some implementations, the roller tube bottom attachment 22 comprises a top section 22*b*. In some implementations, the attachment top section 22*b* is sized to fit snuggly inside the hollow center of the roller tube 5.

In some implementations, the connection between the roller tube 5 and the bottom attachment 22 at the top section 22*b* can be made in many ways, such as by a friction fit, adhesive, screw(s), nail(s), compression fit, or set screw(s).

In some implementations, the roller tube bottom attachment 22 connects to the bottom side of the roller tube 5 so that the bottom attachment 22 and the roller tube 5 both rotate together. In some implementations, rotation by the roller tube 5 causes the bottom attachment 22 to rotate in unison at the same angular velocity. Similarly, in some implementations, rotation by the bottom attachment 22 causes the roller tube 5 to rotate in unison at the same angular velocity.

As shown in FIGS. 7*a* and 7*b*, in some implementations, the roller tube bottom attachment 22 comprises a flange 22*c*. In some implementations, the flange 22*c* extends outward from the center of the bottom attachment 22.

In some implementations, the flange 22*c* is located on the bottom attachment 22. In some implementations, the flange 22*c* is located below the point where the top section 22*b* of the bottom attachment 22 extends into the roller tube 5.

In some implementations, the flange 22*c* is sized to at least extend to the diameter of the roller blind sheet 130 when it is retracted and rolled onto the roller tube 5.

In some implementations, the flange 22*c* provides a shelf support to the bottom of the roller blind sheet 130 when it is rolled onto the roller tube 5. In some implementations, the shelf support provided by the flange 22*c* prevents the roller blind sheet 130 from falling from the roller tube 5.

In some implementations, the shelf support provided by the flange 22*c* prevents the roller blind sheet 130 from interfering with other parts of the roller blind assembly 100.

As shown in FIGS. 7*a* and 7*b*, in some implementations, the roller tube assembly 120 comprises a tether attachment 23. In some implementations, the tether attachment 23 positions over the bottom attachment 22 below the flange 22*c*.

In some implementations, the tether attachment 23 couples the tether 16 to the bottom attachment 22.

In some implementations, the tether attachment 23 has a cylindrical shape with a hollow center. In some implementations, the hollow center is large enough to fit over the main center section of the bottom attachment 22 between the flange 22*c* and the bottom portion 22*a*.

In some implementations, the tether attachment 23 connects to the bottom attachment 22 by a screw 23*b* or other way of connection while positioned over the bottom attachment 22.

In some implementations, the tether attachment 23 and the bottom attachment 22 are connected together to rotate in unison at the same angular velocity. In some implementations, the tether attachment 23 and the bottom attachment 22 therefore rotate in unison with the roller tube 5 connected to the bottom attachment 22. Furthermore, in some implementations, the rotation of any one of the roller tube 5, the bottom attachment 22, or the tether attachment 23 therefore causes the rotation of the other foregoing connected components.

In some implementations, the tether 16 connects to the tether attachment 23 by the screw 23*b* or other way of connection. In some implementations, the tether 16 anchors to the head of the screw 23*b* to connect to the tether attachment 23.

In some implementations, the tether 16 can be connected to the tether attachment 23 by the screw 23*b* in many ways, such as by tying or pinning the tether 16.

As shown in FIGS. 7*a* and 7*b*, in some implementations, the tether attachment 23 comprises a lower flange 23*a*.

In some implementations, the lower flange 23*a* is small enough to allow the tether attachment 23 and the bottom attachment 22 to position between the retracted side 2*a* and the retracted side bracket 12, described below, without causing interference with other parts of the roller blind assembly 100.

In some implementations, the lower flange 23*a* provides a shelf support to the tether 16 when it is rolled onto the tether attachment 23.

In some implementations, the shelf support provided by the lower flange 23*a* prevents the tether 16 from falling from the tether attachment 23. In some implementations, the shelf support provided by the lower flange 23*a* prevents the tether 16 from interfering with other parts of the roller blind assembly 100, such as becoming entangled in the chain 9 or sprocket 28, described below.

In some implementations, the tether attachment 23 and the bottom attachment 22 may be integrated as a single part.

As shown in FIGS. 5 and 6, in some implementations, the top of the roller tube 5 is held in place by a roller tube top bracket 24. In some implementations, the top bracket 24 is connected to the frame retracted side 2*a* near the top of the roller tube 5.

In some implementations, the top bracket 24 can be connected to the frame retracted side 2*a* in various ways, such as by screw(s), nail(s), or adhesive.

In some implementations, the top bracket 24 is positioned high enough on the roller tube 5 to prevent any interference with the roller blind sheet 130.

In some implementations, the top bracket 24 comprises a cylindrical opening that fits around the roller tube 5. In some implementations, the roller tube 5 can rotate freely inside this cylindrical opening with very little friction or resistance from the roller tube top bracket 24.

In some implementations, the top bracket 24 prevents the top of the roller tube 5 from moving away from the top bracket 24.

Figure 8A:
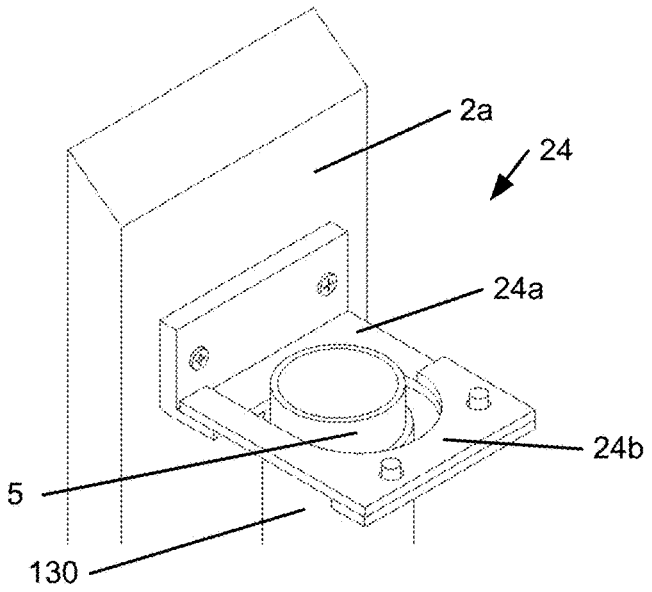
FIGS. 8*a* and 8*b* illustrate an assembled and disassembled view respectively of the roller tube top bracket of the roller blind assembly according to the present disclosure.
Figure 8B:
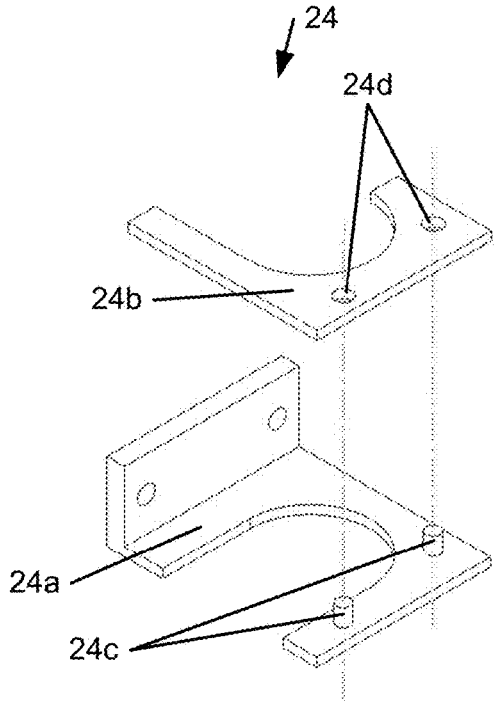

As shown in FIGS. 8*a* and 8*b*, in some implementations, the top bracket 24 comprises two sections 24*a*, 24*b*. In some implementations, the sections 24*a*, 24*b* can be connected and separated for ease of installation or removal of the roller tube 5 from the roller blind assembly 100.

In some implementations, the first or stationary section 24*a* comprises a cutout portion. In some implementations, the cutout is wide enough to allow the top portion of the roller tube 5 to slide out of the top bracket 24. In some implementations, the cutout allows the roller tube 5 to slide out of the top bracket 24 when the second or removable section 24*b* is separated from the stationary section 24*a*.

As shown in FIG. 8*b*, in some implementations, the stationary section 24*a* comprises multiple extensions 24*c*. In some implementations, the extensions 24*c* fit snuggly into holes 24*d* in the removable section 24*b*. In some implementations, the extensions 24*c* hold the removable section 24*b* in place and prevent movement away from the top bracket 24.

In some implementations, the extensions 24*c* fit snuggly enough in the holes 24*d* to prevent separation of the removable section 24*b* from the stationary section 24*a*, such as during operation of the roller blind assembly 100.

In some implementations, the removable section 24*b* can be attached to the stationary section 24*a* to assemble the bracket 24 in various ways, such as by screws, nuts and bolts, adhesive, or hinges.

As introduced above, in some implementations, the roller blind assembly 100 may be rotated bottom side 2*b* up for use in an angled architectural opening with an angled bottom side instead of an angled top side. In some implementations, for such rotated assembly 100, an additional bracket (not shown) is mounted at the top side of the roller tube 5. In some implementations, this additional bracket is connected to the frame retracted side 2*a* similar to how the top bracket 24 is connected to the frame retracted side 2*a*.

In some implementations, such additional bracket comprises a shelf portion (not shown). In some implementations, this shelf portion is positioned at the top side of the roller tube 5. In some implementations, for such rotated assembly 100, this shelf portion prevents the roller tube 5 from being pulled downward, e.g. by gravity, from the assembly 100.

In some implementations, for such rotated assembly 100, the top bracket 24 is rotated so that the removable section 24*b* positions on top of the stationary section 24*a*.

Figure 9:
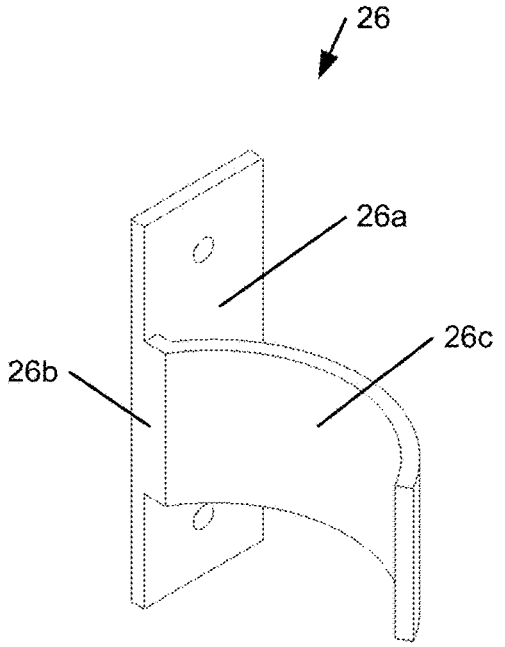
FIG. 9 illustrates a perspective view of the roller sheet guide of the roller blind assembly according to the present disclosure.

As shown in FIGS. 1*b* and 9, in some implementations, the roller tube assembly 120 further comprises a roller sheet guide 26.

In some implementations, the guide 26 is attached to the first side 2*a* of the frame 110. In some implementations, the guide 26 is attached adjacent to the tube 5 of the roller tube assembly 120. In some implementations, the guide 26 is attached at a mid-length of the tube 5.

In some implementations, the guide 26 comprises a curved portion 26*c* that partially extends around and adjacent to the tube 5.

In some implementations, the guide 26 guides and maintains the roller blind sheet 130 firmly around the tube 5 as the roller blind sheet 130 is retracted and rolled up around the tube 5.

As shown in FIG. 6, in some implementations, the guide 26 is positioned midway up from the frame bottom side 2*b* with respect to the roller tube 5. For example, in some implementations, the guide 26 is positioned approximately one-third to one-half of the way up the roller tube 5 from the frame bottom side 2*b*.

In some implementations, the guide 26 is attached to the frame retracted side 2*a*.

In some implementations, the guide 26 can be attached to the frame retracted side 2*a* in various ways, such as by screws, nails, or adhesive.

As shown in FIG. 9, in some implementations, the guide 26 comprises a curved flange 26*c* that mirrors the outside shape of the roller tube bottom attachment flange 22*c*. In some implementations, this curved flange 26*c* is positioned adjacent to the exterior side 100*b* of the roller guide assembly 100.

In some implementations, the curved flange 26*c* of the guide 26 is connected to another set of flanges 26*a*, 26*b*. In some implementations, these flanges 26*a*, 26*b* allow the curved flange 26*c* of the guide 26 to be positioned to compliment the outer edge of the bottom attachment flange 22*c*.

In some implementations, the guide 26 is attached to the frame retracted side 2*a* at the retracted side flange 26*a* of the guide 26. In some implementations, the guide 26 can be attached to the frame retracted side 2*a* in various ways, such as by screws, nails, or adhesive.

In some implementations, the guide 26 forces the roller blind sheet 130 back toward the center axis of the roller tube 5 in the event that the roller blind sheet 130 becomes loose around the roller tube 5. In some implementations, this helps minimize the potential that the roller blind sheet 130 will fall below or to the bottom side of the bottom attachment flange 22*c* and interfere with other parts of the roller blind assembly 100.

Figure 10:
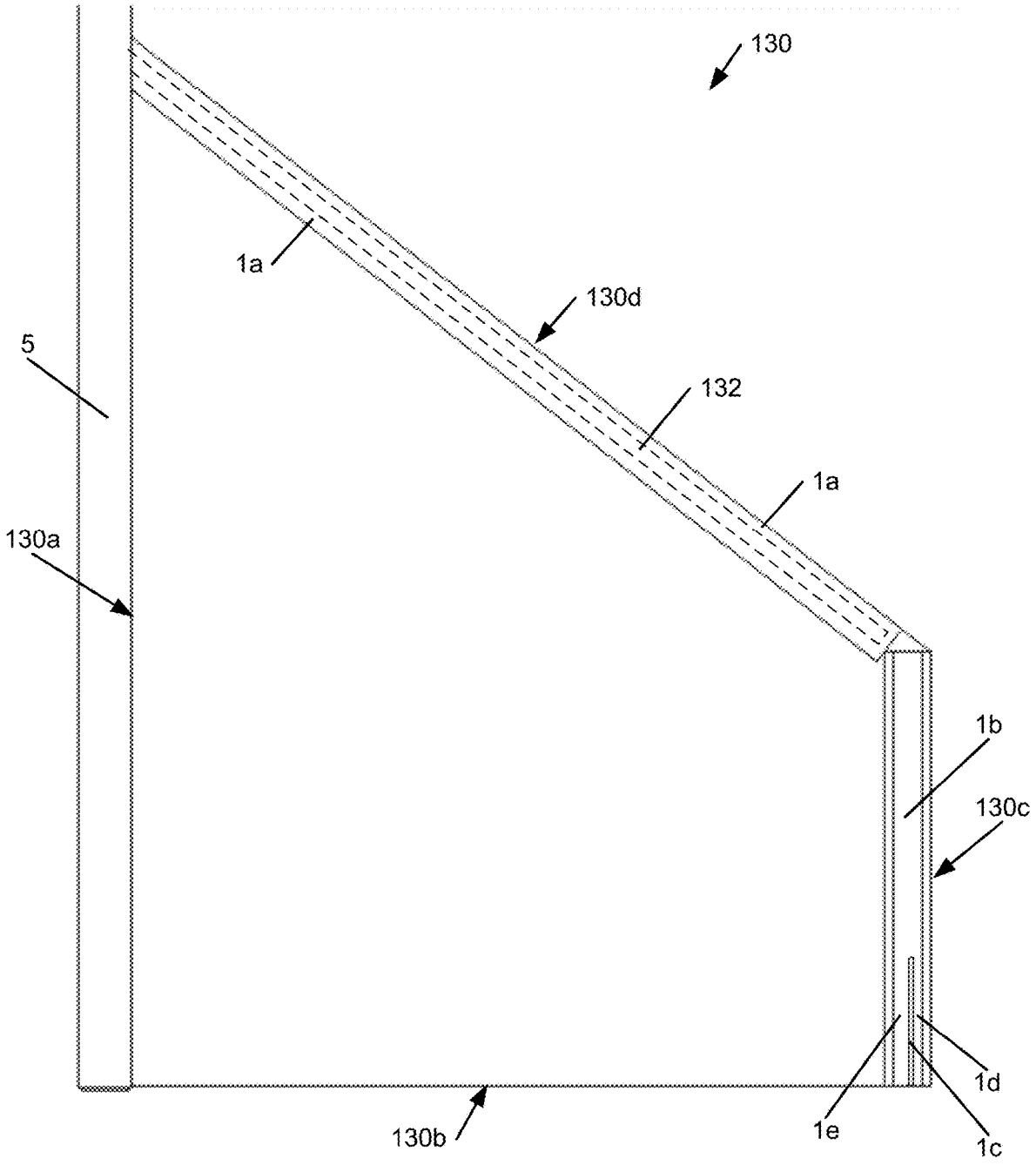
FIG. 10 illustrates a front side or interior side view of the roller blind sheet of the roller blind assembly according to the present disclosure.

As shown in FIG. 10, in some implementations, the roller blind sheet 130 comprises a top edge 130*d*, a bottom edge 130*b*, a first (e.g., left) edge 130*a*, and a second (e.g., right) edge 130*c*.

In some implementations, the edges 130*a*, 130*b*, 130*c*, 130*d* define a shape of the roller blind sheet 130 that corresponds to the modified rectangular shape of the window described above. In some implementations, the shape of the roller blind sheet 130 corresponds to the shape of the window so that the roller blind sheet 130 can fully cover the opening of the window.

In some implementations, the first edge 130*a* is longer than the second edge 130*c*.

In some implementations, the first edge 130*a* is attached to the tube 5 of the roller tube assembly 120 so that the roller blind sheet 130 can be rolled up around the tube 5. In some implementations, the roller blind sheet 130 can be rolled up around the tube 5 to uncover the opening of the window.

In some implementations, the first edge 130*a* is attached to the tube 5 of the roller tube assembly 120 so that the roller blind sheet 130 can be unrolled and extended from the tube 5. In some implementations, the roller blind sheet 130 can be unrolled and extended from the tube 5 to fully cover the opening of the window.

In some implementations, the roller blind sheet 130, when fully extended from the roller tube 5, comprises the shape of the angled architectural opening in which the roller blind assembly 100 is installed. In some implementations, the fully extended roller blind sheet 130 comprises any other desired shape of coverage with respect to the angled architectural opening.

In some implementations, the top edge 130*d* of the roller blind sheet 130 is cut parallel to, but slightly below, the top edge of the angled architectural opening. In some implementations, this shaping of the roller blind sheet 130 allows a path for heat and heated gasses to escape from the exterior side 100*b* of the roller blind sheet 130 and out the top side 100*c* of the roller blind assembly 100.

In some implementations, the roller blind sheet 130 comprises additional material on the roller tube side, or retracted side, 130*a* of the roller blind sheet 130 to allow for the attachment of the roller blind sheet 130 to the roller tube 5.

In some implementations, the roller blind sheet 130 can be attached to the roller tube 5 at this additional material in various ways, such as by tape, glue, staples, screws, or nails.

In some implementations, this additional material of the roller blind sheet 130 that attaches to the roller tube 5 wraps at least partially around the roller tube 5 when the roller blind sheet 130 is fully extended from the roller tube 5.

In some implementations, the top edge 130*d* of the roller blind sheet 130 is stiff to horizontally support the roller blind sheet 130 when extended from the tube 5.

In some implementations, the top edge 130*d* of the roller blind sheet 130 is flexible to allow the roller blind sheet 130 to roll up around the tube 5 when retracted.

As shown in FIG. 10, in some implementations, the roller blind sheet 130 further comprises a narrow elongated sleeve 1*a* and a thin narrow elongated piece of material 132.

In some implementations, the narrow elongated sleeve 1*a* is adjacent to the top edge 130*d* of the roller blind sheet 130.

In some implementations, roller blind sheet 130 comprises additional material on the angled side, e.g. the top side 130*d*, of the roller blind sheet 130. In some implementations, this additional material is folded over and attached to the roller blind sheet 130 to form the sleeve 1*a*.

In some implementations, the folded over additional material can be attached to the roller blind sheet 130 to form the sleeve 1*a* in various ways, such as by sewing, glue, snaps, buttons, staples, or nuts and bolts.

In some implementations, the sleeve 1*a* extends at least partially along the angled side 130*d* of the roller blind sheet 130.

In some implementations, the sleeve 1*a* extends along all of the angled side 130*d* of the roller blind sheet 130, including along the additional material of the roller blind sheet 130 that attaches to the roller tube 5 as described above. Therefore, in some implementations, the sleeve 1*a* wraps at least partially around the roller tube 5 when the roller blind sheet 130 is fully extended.

In some implementations, the piece of material 132 is held within the sleeve 1*a*.

In some implementations, the piece of material 132 provides a stiff horizontal support to the roller blind sheet 130 when extended from the tube 5 of the roller tube assembly 120.

In some implementations, the piece of material 132 provides a flexibility that allows the roller blind sheet 130 to roll up around the tube 5 when the roller blind sheet 130 is retracted.

In some implementations, the sleeve 1*a* houses the piece of material 132.

In some implementations, the piece of material 132 supports the roller blind sheet 130 along the top side and/or the angled side of the roller blind sheet 130.

In some implementations, the piece of material 132 in the sleeve 1*a* provides stability to the top edge and/or the angled edge of the roller blind sheet 130.

In some implementations, the piece of material 132 in the sleeve 1*a* prevents sagging of the roller blind sheet 130 when extended from the roller tube 5.

In some implementations, the piece of material 132 in the sleeve 1*a* is sufficiently flexible and resilient to roll up and wrap around the roller tube 5 and to straighten out and extend from the roller tube 5.

In some implementations, the piece of material 132 in the sleeve 1*a* rolls up and wraps around the roller tube 5 along with the material of the roller blind sheet 130, including the additional material that is attached to the roller tube 5.

In some implementations, the piece of material 132 in the sleeve 1*a* wraps around the roller tube 5 as the roller blind sheet 130 is retracted and wrapped around the roller tube 5.

In some implementations, the piece of material 132 in the sleeve 1*a* straightens out and extends with the roller blind sheet 130 as the roller blind sheet 130 is unwrapped and extended from the roller tube 5.

In some implementations, the piece of material 132 may be a thin piece of metal material.

Considering the foregoing description, in some implementations, the piece of material 132 in the sleeve 1*a* behaves similar to a length of retractable tape measure material that is stored coiled inside a tape measure housing and that extends straight when withdrawn from the housing.

As shown in FIG. 10, in some implementations, the roller blind sheet 130 further comprises a narrow elongated sleeve 1*b*. In some implementations, the narrow elongated sleeve 1*b* is adjacent to the second edge 130*c* of the roller blind sheet 130.

In some implementations, a narrow elongated finger (also referred to herein as an extension rod) 7, which extends upward from the extension assembly 160 as described below, is inserted in the sleeve 1*b* to connect the extension assembly 160 to the roller blind sheet 130.

In some implementations, the roller blind sheet 130 comprises additional material on the extended side 130*c* of the roller blind sheet 130. In some implementations, this additional material is folded over and attached to the roller blind sheet 130 to form the second sleeve 1*b*.

In some implementations, the folded over additional material can be attached to the roller blind sheet 130 to form the sleeve 1*b* in various ways, such as by sewing, glue, snaps, buttons, staples, or nuts and bolts.

In some implementations, the sleeve 1*b* extends vertically along the extended side 130*c* of the roller blind sheet 130.

In some implementations, the sleeve 1*b* extends at least partially along the extended side 130*c* of the roller blind sheet 130.

As shown in FIG. 10, in some implementations, the bottom portion of the sleeve 1*b* on the extended side 130*c* of the roller blind sheet 130 is further attached to the roller blind sheet 130 along a vertical attachment line 1*c* to form two smaller sleeves 1*d*, 1*e*. In some implementations, the two smaller sleeves 1*d*, 1*e* are formed at the bottom of the extended side of the roller blind sheet 130.

In some implementations, the smaller sleeves 1*d*, 1*e* can be formed in various ways, such as by sewing, glue, snaps, buttons, staples, or nuts and bolts.

In some implementations, the extension rod 7 positioned inside the sleeve 1*b* is further positioned inside the retracted side sleeve 1*e* that is formed in the bottom portion of the sleeve 1*b*.

In some implementations, the positioning of the rod 7 in the retracted side sleeve 1*e* causes a tighter fit between the sleeve 1*e* and the bottom portion of the extension rod 7 close to the extension assembly 160.

In some implementations, the positioning of the rod 7 in the retracted side sleeve 1*e* causes a looser fit between the sleeve 1*b* and the top portion of the extension rod 7.

In some implementations, the tighter fit between the retracted side sleeve 1*e* and the bottom of the extension rod 7 minimizes the torque created on the extension assembly 160 about an axis through the extension assembly 160 perpendicular to the extension track 8, described below.

In some implementations, the tighter fit between the sleeve 1*e* and the extension rod 7 minimizes the torque as the extension assembly 160 is pushed by the engaging extension 9*a* to extend the roller blind. In some implementations, the tighter fit between the sleeve 1*e* and the extension rod 7 minimizes the torque when the extension assembly 160 is pulled back toward the roller tube 5 as the roller blind sheet 130 is retracted onto the roller tube 5.

In some implementations, the top portion of the sleeve 1*b* on the extended side 130*c* of the roller blind sheet 130 fits more loosely around the top of the extension rod 7 when compared to the smaller sleeve 1*e* at the bottom of the extension rod 7.

In some implementations, this allows the top portion of the extension rod 7 to provide structural support to the roller blind sheet 130. In some implementations, this allows the top portion of the extension rod 7 to prevent the roller blind sheet 130 from falling from the extension rod 7. In some implementations, structural support is therefore created for the extended side 130*c* of the roller blind sheet 130 by the extension rod 7.

In some implementations, the tube 5 of the roller tube assembly 120 and the attached roller blind sheet 130 may be integrated or combined as a single component, such as or similar to a roller blind.

In some implementations, the roller blind sheet 130 may be any flexible material that can be used to cover an angled architectural opening and can wrap around a roller tube 5 when retracted.

In some implementations, the roller blind sheet 130 may be any material that can be used to completely, substantially, partially, or minimally block out light, a view, and/or radiant or heat energy from traversing through an angled architectural opening.

In some implementations, the roller blind sheet 130 may be a material that is referred to as blinds, shades, coverings, solar shades, or solar blinds.

Although parts of the sleeves 1*a*, 1*b*, 1*d*, 1*e* such as the attachment 1*c*, flaps, seams, etc. are shown in FIG. 10 for description purposes, in some implementations, such parts of the sleeves 1*a*, 1*b*, 1*d*, 1*e* may be hidden or otherwise not visible, e.g. on one or both sides of the roller blind sheet 130.

Figure 12:
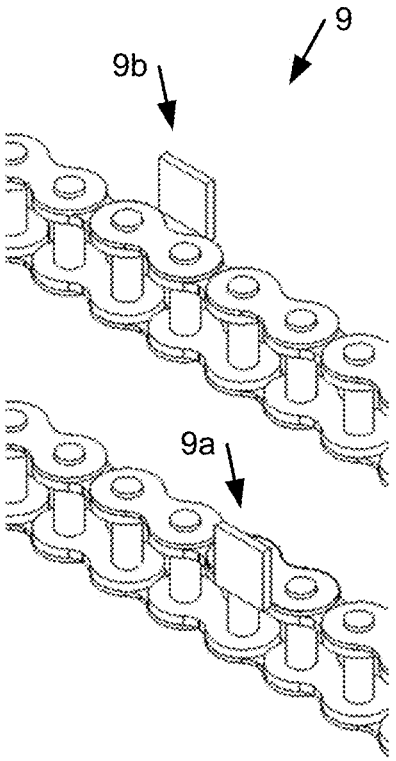
FIG. 12 illustrates a partial perspective view of the chain of the chain assembly of the roller blind assembly according to the present disclosure including the engaging extensions.

As shown in FIGS. 1*c* and 12, in some implementations, the chain assembly 140 comprises a chain 9. In some implementations, the chain assembly 140 is attached to the frame 110.

In some implementations, the chain 9 comprises a roller type chain. In some implementations, the chain 9 comprises any other suitable type of chain.

In some implementations, the chain 9 extends in a horizontal loop between the first side 2*a* and the second side 2*c* of the frame 110 adjacent to the bottom side 2*b* of the frame 110. In some implementations, the horizontal loop in which the chain 9 extends is elliptical shaped.

In some implementations, the horizontal loop in which the chain 9 extends has any other suitable shape.

In some implementations, the chain 9 is moveable along the horizontal loop. In some implementations, the chain 9 travels around the track assembly 150.

In some implementations, the chain 9 comprises a first engaging extension 9*a* and a second engaging extension 9*b*.

As shown in FIG. 12, in some implementations, the first engaging extension 9*a* and the second engaging extension 9*b* each comprise a substantially rectangular shaped plate. In some implementations, the first engaging extension 9*a* and the second engaging extension 9*b* may each comprise a plate having any other suitable shape.

In some implementations, the first engaging extension 9*a* and the second engaging extension 9*b* may each comprise any other suitable configuration, such as a finger of any suitable shape.

In some implementations, the first engaging extension 9*a* and the second engaging extension 9*b* are each attached to the chain 9. In some implementations, the first engaging extension 9*a* and the second engaging extension 9*b* each extend from the chain 9.

In some implementations, the first engaging extension 9*a* and the second engaging extension 9*b* are attached to the chain 9 so that the extensions 9*a*, 9*b* can position and extend from the chain 9 on a same side or on different sides of the horizontal loop of travel of the chain 9 during operation of the assembly 100.

In some implementations, the chain 9 may comprise just a single engaging extension instead of the two extensions 9*a*, 9*b*. In some implementations, such single engaging extension is the same or similar to either of the extensions 9*a*, 9*b*. In some implementations, such single engaging extension can provide essentially the same or substantially similar function as the two extensions 9*a*, 9*b* for the operation of the roller blind assembly 100 as described below.

As shown in FIGS. 7*a*-7*b* and 16*a*-16*b*, in some implementations, the chain assembly 140 may comprise two sprockets 28, 30. In some implementations, the sprockets 28, 30 allow the chain 9 to move in the travel path on the roller blind assembly 100.

In some implementations, the first sprocket 28 may be a plate sprocket.

In some implementations, the first sprocket 28 is positioned near the roller tube 5. As shown in FIGS. 7*a* and 7*b*, in some implementations, the first sprocket 28 is positioned near the base of the roller tube bottom attachment 22.

In some implementations, the first sprocket 28 rotates freely around the bottom attachment 22.

In some implementations, the movement of the chain 9 controls the rotation of the first sprocket 28. In some implementations, the rotation of the first sprocket 28 does not cause the bottom attachment 22 or the roller tube 5 to rotate.

Similarly, in some implementations, the rotation of the roller tube 5 or the bottom attachment 22 does not cause the first sprocket 28 to rotate. In some implementations, the first sprocket 28 is positioned on top of a bushing 29. In some implementations, the bushing 29 is positioned on the frame bottom side 2*b*.

In some implementations, the bushing 29 prevents the first sprocket 28 from interfering with the frame bottom side 2*b*. Similarly, in some implementations, the bushing 29 prevents the chain 9 from interfering with the frame bottom side 2*b* as the chain 9 rotates around the first sprocket 28.

In some implementations, the bushing 29 is positioned around the center cylinder of the roller tube bottom attachment 22. In some implementations, the position of the bushing 29 prevents the movement of the bushing 29 away from the bottom attachment 22.

As introduced above, in some implementations, the roller blind assembly 100 may be rotated bottom side 2*b* up for use in an angled architectural opening with an angled bottom side instead of an angled top side. In some implementations, for such rotated assembly 100, another bushing that is like the bushing 29 is positioned along the rotational axis of the roller tube bottom attachment 22 adjacent to the top side of the sprocket 28.

In some implementations, for such rotated assembly 100, this additional bushing prevents gravity from pulling the sprocket 28 against the lower flange 23*a* of the roller tube bottom attachment 22. In some implementations, this additional bushing also prevents interference between the lower flange 23*a* and the chain 9 or engaging extensions 9*a*, 9*b*.

Figure 16A:
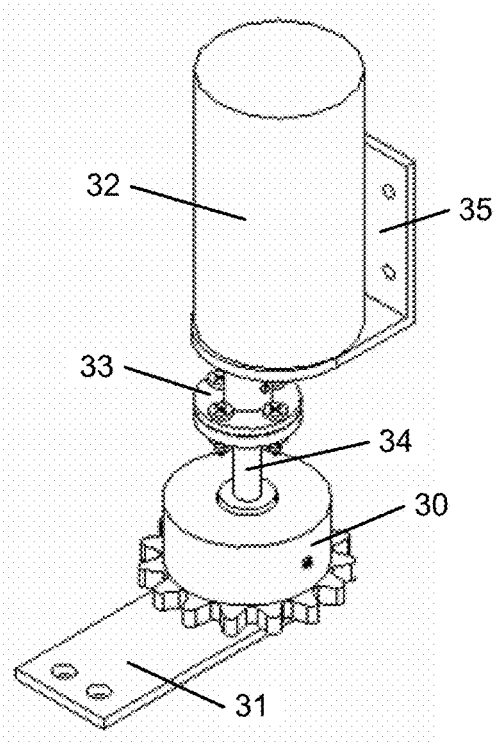
FIGS. 16*a* and 16*b* illustrate a side perspective view and a corresponding exploded view respectively of the motor assembly of the roller blind assembly according to the present disclosure.
Figure 16B:
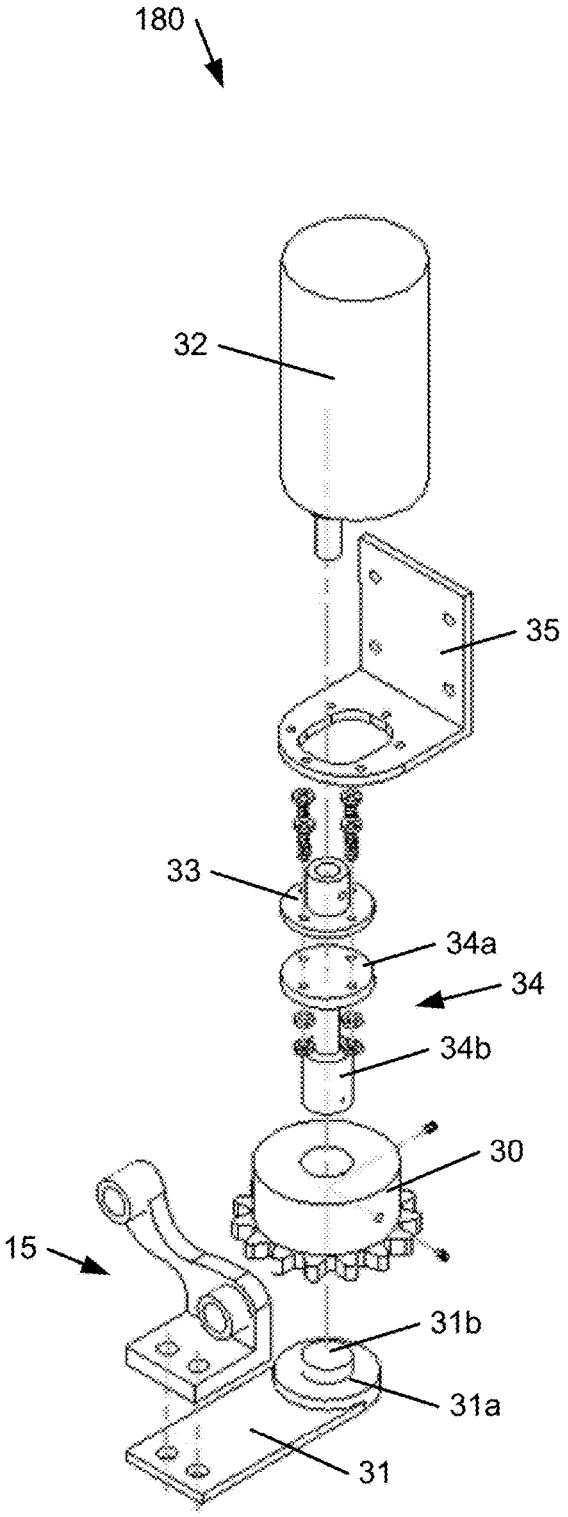

As shown in FIGS. 16*a* and 16*b*, in some implementations, the second sprocket 30 is positioned near the frame bottom side 2*b* on the extended side 2*c* of the roller blind assembly 100. In some implementations, the second sprocket 30 is positioned on top of a bracket 31.

As shown in FIG. 16*b*, in some implementations, the bracket 31 comprises a raised cylindrical section 31*a*. In some implementations, the second sprocket 30 is positioned on top of the cylindrical section 31*a*.

In some implementations, the cylindrical section 31*a* raises the sprocket 30 off of the bracket 31. In some implementations, the cylindrical section 31*a* prevents interference between the sprocket 30 and the frame bottom side 2*b*.

In some implementations, the bracket 31 comprises a second raised cylindrical section 31*b*. In some implementations, the second cylindrical section 31*b* is positioned on top of the first cylindrical section 31*a*.

In some implementations, the second cylindrical section 31*b* is large enough to prevent excess movement of the sprocket 30 away from the bracket 31.

In some implementations, the second cylindrical section 31*b* is small enough to allow the sprocket 30 to rotate freely on the bracket 31 with minimal friction between the bracket 31 and the sprocket 30.

In some implementations, the bracket 31 prevents the sprocket 30 from interfering with the frame bottom side 2*b*. Similarly, in some implementations, the sprocket 30 prevents the chain 9 from interfering with the frame bottom side 2*b* as the chain 9 rotates around the sprocket 30.

In some implementations, the bracket 31 is connected to the frame bottom side 2*b*.

In some implementations, the bracket 31 can be attached to the frame bottom side 2*b* in various ways, such as by screws, nails, or adhesives.

As shown in FIG. 16*b*, in some implementations, attachment points for the bracket 31 are aligned with attachment points on the retraction track bracket 15 on the extended side 2*c* of the roller blind assembly 100. In some implementations, this is for easier assembly and alignment of components of the assembly 100 to prevent interference during operation.

As shown in FIGS. 16*a* and 16*b*, in some implementations, the second sprocket 30 may be directly coupled to an attachment 34 that extends from the shaft of a motor 32, described below. In some implementations, the sprocket 30 may be a finished bore sprocket.

As shown in FIG. 1*c*, in some implementations, the track assembly 150 comprises an extension track 8 and a retraction track 14.

In some implementations, the extension track 8 and the retraction track 14 each extend between the first side 2*a* and the second side 2*c* of the frame 110. In some implementations, the extension track 8 and the retraction track 14 each extend adjacent to the bottom side 2*b* of the frame 110.

Figure 11:
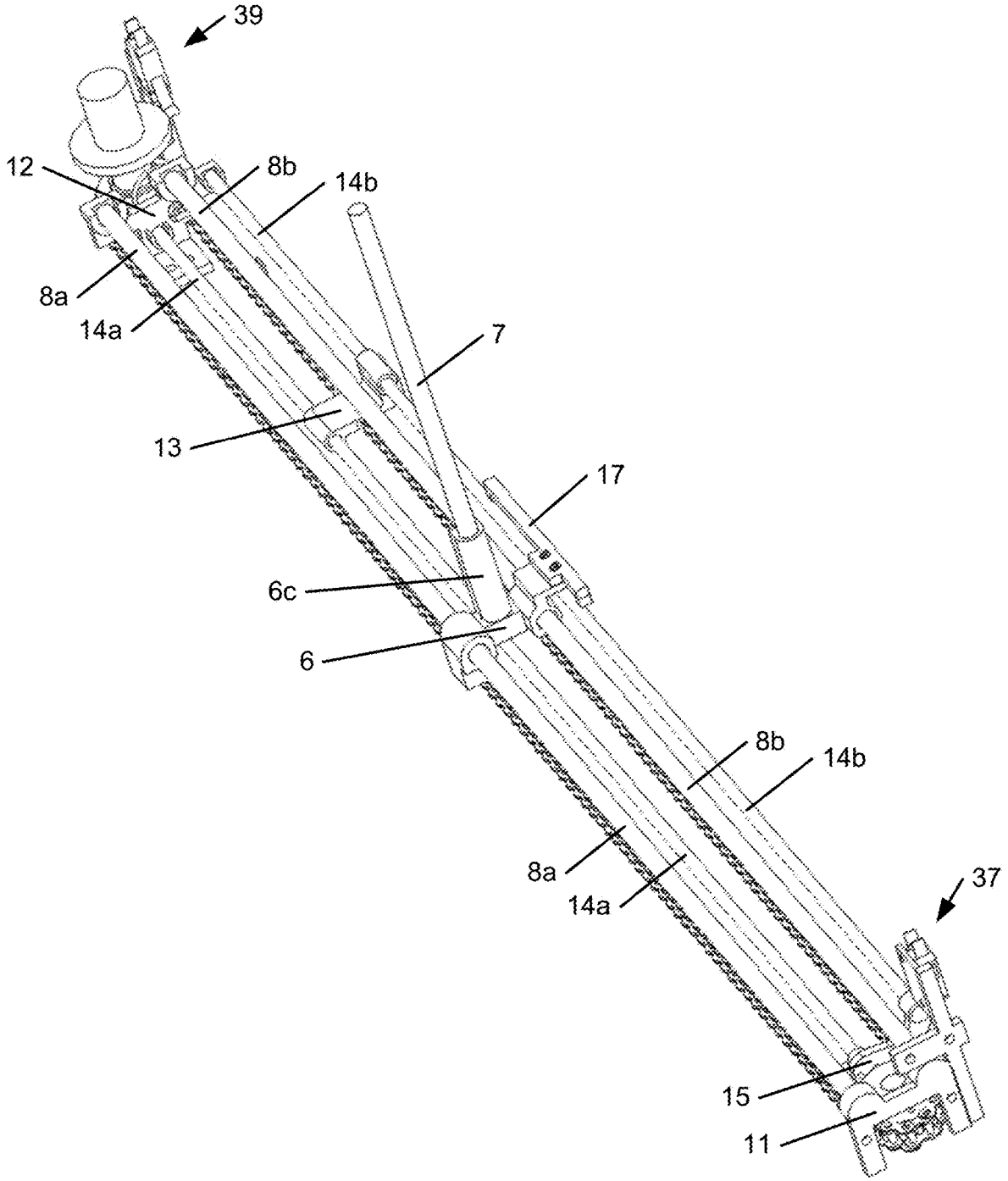
FIG. 11 illustrates another top side perspective view of the track assembly and other components of the roller blind assembly according to the present disclosure.

As shown in FIG. 11, in some implementations, the extension track 8 and the retraction track 14 each comprise a pair of rods 8*a*, 8*b*, 14*a*, 14*b* respectively extending between the first side 2*a* and the second side 2*c* of the frame 110.

In some implementations, the extension track 8 is positioned near the bottom of the roller blind assembly 100 and extends between the retracted side 2*a* and the extended side 2*c* of the assembly 100.

In some implementations, the extension track 8 can be made from various different designs and materials. In some implementations, the extension track 8 comprises rods 8*a*, 8*b*.

In some implementations, the extension track rods 8*a*, 8*b* are held above the frame bottom side 2*b* of the roller blind assembly 100. As shown in FIG. 11, in some implementations, the rods 8*a*, 8*b* are held in place by brackets 11, 12.

Figure 13A:
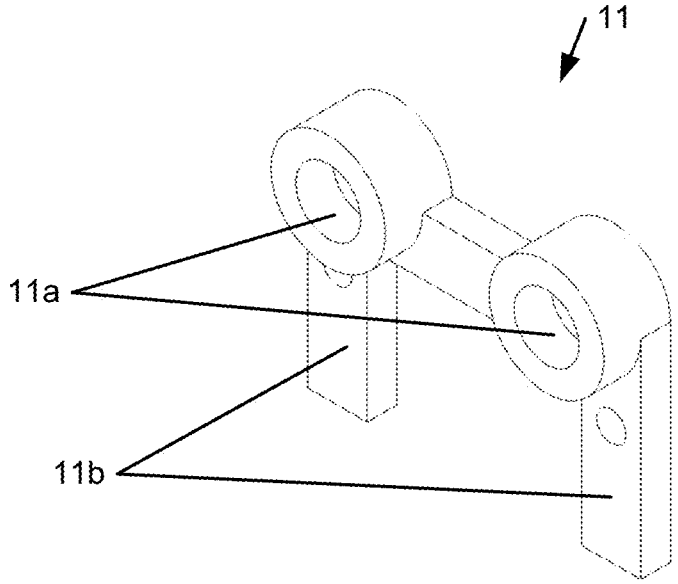
FIG. 13*a* illustrates a perspective view of the extended side extension track bracket of the track assembly of the roller blind assembly according to the present disclosure.

As shown in FIG. 13*a*, in some implementations, the extended side bracket 11 comprises two hollow cylinder openings 11*a*. In some implementations, the track rods 8*a*, 8*b* fit snuggly into the openings 11*a*.

In some implementations, the extended side extension track bracket 11 comprises two attachment extensions 11*b*. In some implementations extensions 11*b* comprise holes that allow the extended side bracket 11 to be attached to the frame extended side 2*c*. In some implementations, attaching the extended side bracket 11 to the frame extended side 2*c* allows for maximum travel of the extension cart 6 toward the extended side 2*c*.

In some implementations, the extended side bracket 11 can be attached to the assembly frame extended side 2*c* in various ways such as by screws or adhesive.

Figure 13B:
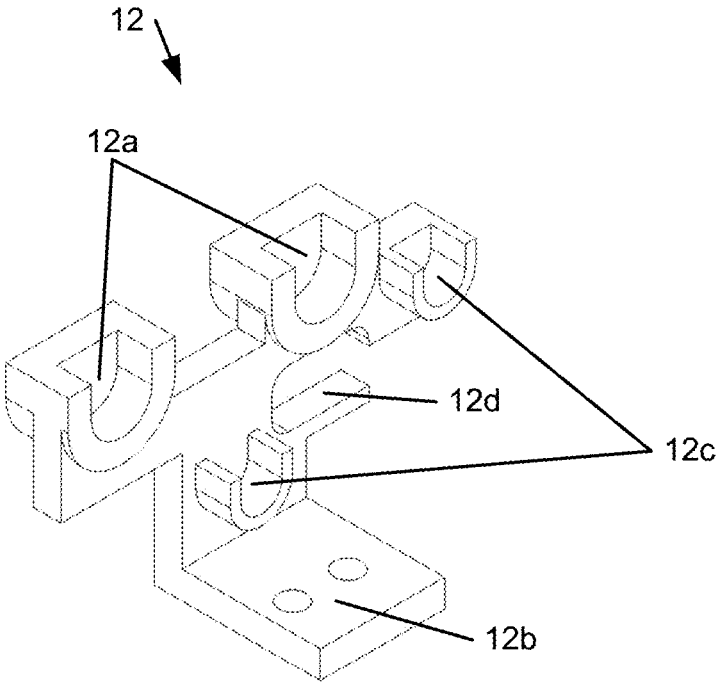
FIG. 13*b* illustrates a perspective view of the retracted side track assembly bracket of the track assembly of the roller blind assembly according to the present disclosure.

As shown in FIG. 13*b*, in some implementations, the retracted side track assembly bracket 12 comprises two hollow cylinder openings 12*a*. In some implementations, the hollow cylinder openings 12*a* are the same or similar to the above described hollow cylinder openings 11*a* of the extended side bracket 11.

In some implementations, for ease of positioning or removal of the extension track rods 8*a*, 8*b*, a top portion of the hollow cylinder openings 12*a* is omitted. In some implementations, this variation of the hollow cylinder openings 12*a* allows the track rods 8*a*, 8*b* to be positioned in or removed from the hollow cylinder openings 12*a* while positioned in the other hollow cylinder openings 11*a* with the brackets 11, 12 attached to the roller blind assembly 100.

In some implementations, the retracted side bracket 12 also comprises an attachment extension flange 12*b*. In some implementations, the attachment flange 12*b* comprises holes that allow the retracted side bracket 12 to be attached to the frame bottom side 2*b*.

In some implementations, the retracted side bracket 12 can be attached to the frame bottom side 2*b* in various ways such as by screws or adhesive.

In some implementations, the retracted side track assembly bracket 12 may comprise two additional hollow cylinder openings 12*c*. In some implementations, these additional hollow cylinder openings 12*c* may have a half cylinder shape variation similar to the above described variation of the hollow cylinder openings 12*a*.

As shown in FIG. 11, in some implementations, the additional hollow cylinder openings 12*c* hold the retracted side of the retraction track 14 used for the travel of the retraction cart 13, as described below.

In some implementations, the retraction track 14 can be made from various different designs and materials. In some implementations, the retraction track 14 comprises two rods 14*a*, 14*b*.

In some implementations, the retraction track 14 is positioned near the bottom of the roller blind assembly 100 and extends along the extend/retract axis.

In some implementations, the retraction track rods 14*a*, 14*b* are held above the frame bottom side 2*b* of the roller blind assembly 100. As shown in FIG. 11, in some implementations, the rods 14*a*, 14*b* are held in place by brackets 12, 15.

Figure 13C:
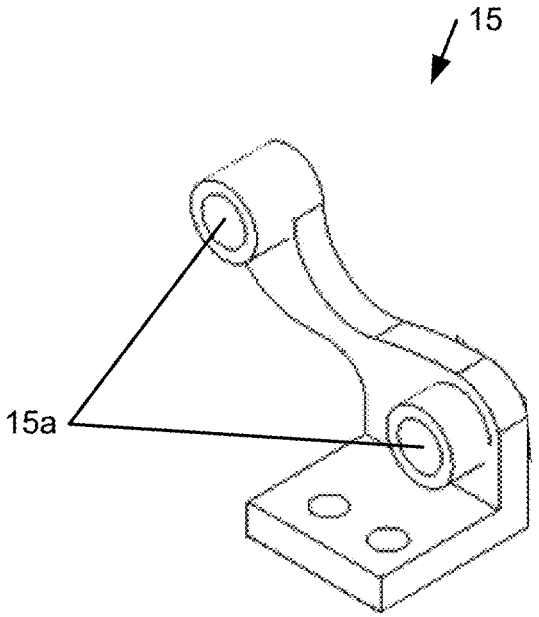
FIG. 13*c* illustrates a perspective view of the extended side retraction track bracket of the track assembly of the roller blind assembly according to the present disclosure.

As shown in FIG. 13*c*, in some implementations, the extended side retraction track bracket 15 comprises two hollow cylinder openings 15*a*. In some implementations, the track rods 14*a*, 14*b* fit snuggly into the openings 15*a*.

As shown in FIG. 16*b*, in some implementations, the bracket 15 is attached to the frame bottom side 2*b* on top of the bracket 31 of the chain assembly 140 and/or the motor assembly 180.

In some implementations, the bracket 15 can be attached to the frame bottom side 2*b* in various ways such as by screws, nails, or adhesive.

In some implementations, the retracted side 2*a* of the retraction track rods 14*a*, 14*b* are held in place by the retracted side bracket 12, introduced above with respect to the extension track 8.

As shown in FIG. 13*b*, in some implementations, in addition to what is described above, the bracket 12 further comprises a flange 12*d*. In some implementations, the flange 12*d* extends toward the exterior side 100*b* of the roller blind assembly 100.

In some implementations, the flange 12*d* positions below the tether 16. In some implementations, the flange 12*d* helps to prevent the tether 16 from interfering with the chain 9, engaging extensions 9*a*, 9*b*, and sprocket 28 in the event that the tether 16 becomes slack during operation of the roller blind assembly 100.

In some implementations, the flange 12*d*, along with the body of the bracket 12, helps guide the tether 16 and prevent excess travel of the tether 16 away from the roller blind assembly 100.

In some implementations, the flange 12*d* also helps to maintain the tether 16 above the tether attachment flange 23*a* in the event that the tether 16 becomes slack during operation of the roller blind assembly 100.

In some implementations, the retracted side bracket 12 may comprise separate brackets (not shown) for the extension track rods 8*a*, 8*b* and for the retraction track rods 14*a*, 14*b*.

As introduced above, in some implementations, the roller blind assembly 100 may be rotated bottom side 2*b* up for use in an angled architectural opening with an angled bottom side instead of an angled top side. In some implementations, for such rotated assembly 100, the hollow cylinder openings 12*a*, 12*c* of the bracket 12 with top portions omitted are rotated, e.g., flipped, to prevent gravity from pulling the track rods 8*a*, 8*b*, 14*a*, 14*b* out of the openings 12*a*, 12*c* respectively.

In some implementations, a hardware screw eye (not shown) is positioned toward the retracted side 2*a* of the roller blind assembly 100 adjacent to the bracket 12. In some implementations, the screw eye is also positioned near the tether attachment flange 23*a*. In some implementations, the tether 16 extends through the screw eye and then over the bracket flange 12*d*.

In some implementations, the screw eye guides the tether 16. In some implementations, the screw eye prevents the tether 16 from interfering with other components of the roller blind assembly 100.

In some implementations, the screw eye also prevents excess movement of the tether 16 away from the roller blind assembly 100.

In some implementations, the tether 16 can be guided in other ways that are similar to the screw eye, such as described herein.

As shown in FIG. 1*c*, in some implementations, the extension assembly 160 is moveably connected to the extension track 8. In some implementations, the extension assembly 160 can move along the extension track 8 between the first side 2*a* and the second side 2*c* of the frame 110.

In some implementations, the extension assembly 160 is engageably coupleable to the chain 9 by the body 6 of the extension assembly 160. In some implementations, a movement of the first engaging extension 9*a* toward the extension assembly 160 by a movement of the chain 9 causes the first engaging extension 9*a* to engage the body 6 of the extension assembly 160. In some implementations, the movement of the first engaging extension 9*a* causes the chain 9 to couple to the extension assembly 160 to move the extension assembly 160 along the extension track 8.

As shown in FIG. 1*a*, in some implementations, the extension assembly 160 is connected to the roller blind sheet 130 by the rod 6*c*, 7 of the extension assembly 160 adjacent to the second edge 130*c* of the roller blind sheet 130. In some implementations, a movement of the extension assembly 160 along the extension track 8 by the chain 9 causes an unrolling of the roller blind sheet 130 from the tube 5. In some implementations, the movement of the extension assembly 160 causes an extending of the roller blind sheet 130 horizontally across the frame 110.

As shown in FIG. 1*c*, in some implementations, the extension assembly 160 further comprises a narrow elongated finger (also referred to herein as an extension rod) 7, described more below. In some implementations, the finger 7 extends upward from the extension assembly 160.

As shown in FIG. 1*a*, in some implementations, the finger 7 is inserted in the sleeve 1*b* of the roller blind sheet 130, described above, to connect the extension assembly 160 to the roller blind sheet 130.

Figure 14A:
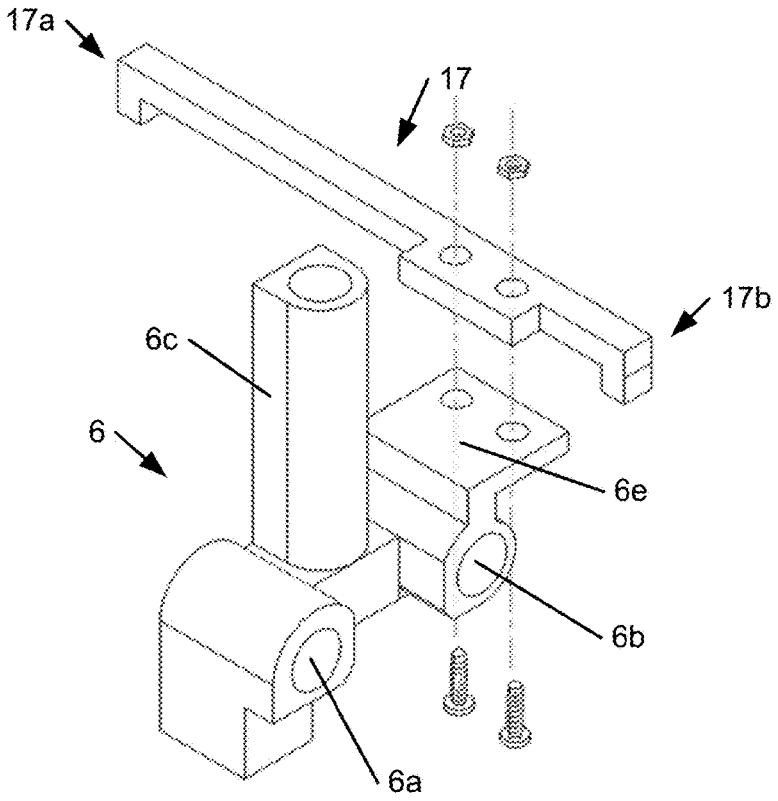
FIGS. 14*a* and 14*b* illustrate side and bottom perspective views respectively of parts of the extension assembly of the roller blind assembly according to the present disclosure.
Figure 14B:
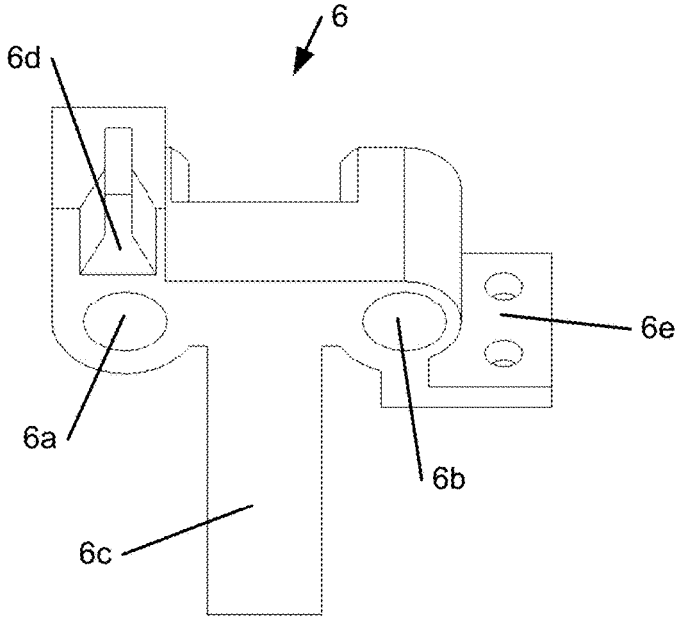

As shown in FIGS. 11 and 14*a*-14*b*, in some implementations, the extension assembly 160 comprises a substantially rectangular prism shaped body 6 having a pair of openings 6*a*, 6*b* extending therethrough and a rod 6*c*, 7 extending therefrom, as described herein. In some implementations, the body 6 has any other suitable shape.

In some implementations, the extension assembly 160 comprises an extension cart 6 and an extension rod 7.

In some implementations, the extension cart 6 is moveably connected to the extension track 8 of the track assembly 150.

In some implementations, the extension rod 7 is attached to and extends from the extension cart 6.

In some implementations, the extension rod 7 can be attached or otherwise connected to the extension cart 6 in various ways, such as by screw(s), set screw(s), an adhesive, or a friction fit.

Figure 2:
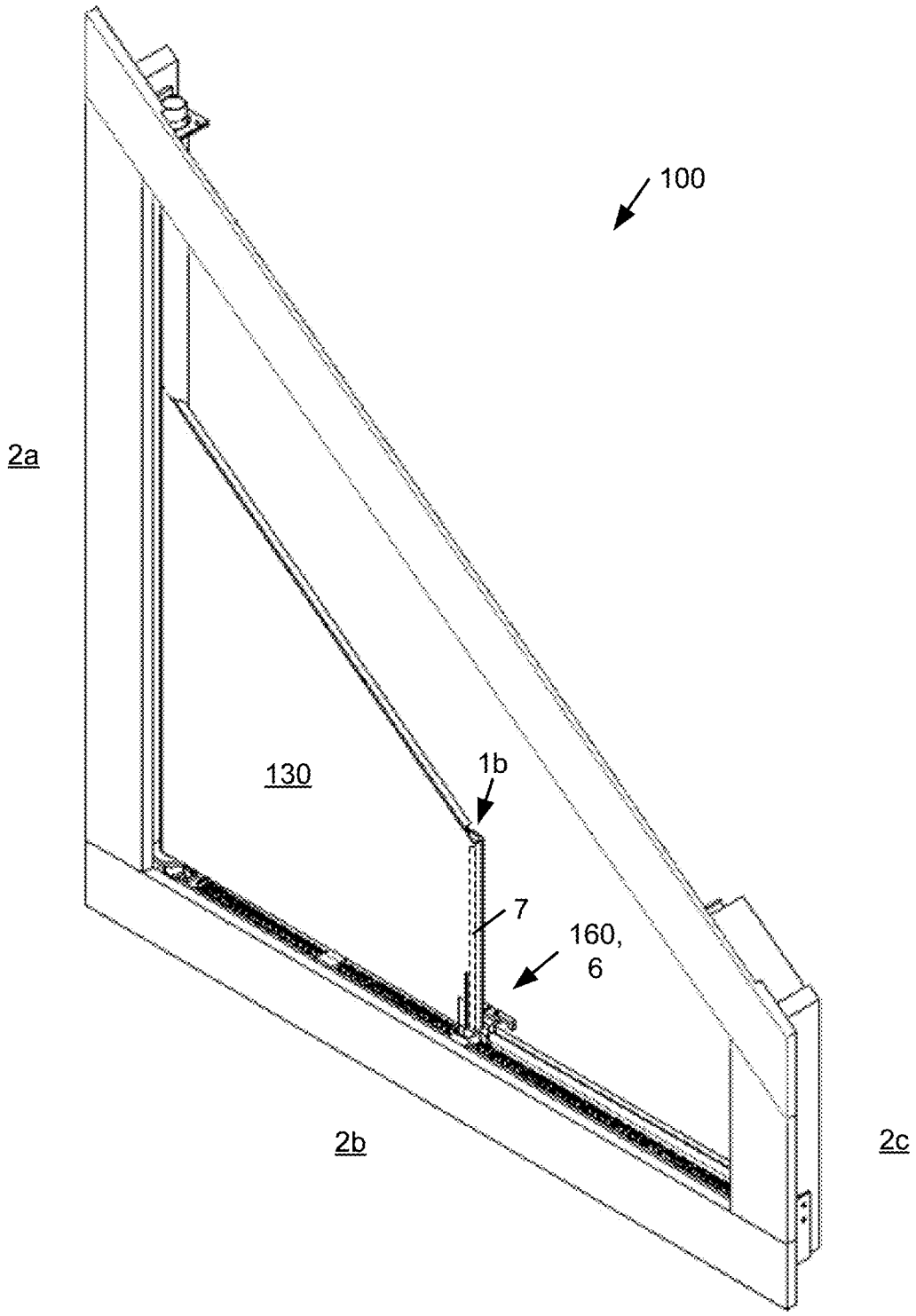
FIG. 2 illustrates another front side or interior side perspective view of the roller blind assembly according to the present disclosure with the roller blind sheet partially extended or retracted.

As shown in FIG. 2, in some implementations, the sleeve 1*b* positions over the extension rod 7.

In some implementations, the extension rod 7 on the extension cart 6 provides support to the extended side 130*c* of the roller blind sheet 130.

In some implementations, the extension rod 7 on the extension cart 6 prevents the extended side 130*c* of the roller blind sheet 130 from falling from the extension rod 7.

In some implementations, the bottom of the sleeve 1*b* sits on top of the extension cart 6, which prevents the roller blind sheet 130 from falling from the extension rod 7.

In some implementations, the positioning of the sleeve 1*b* onto the extension rod 7 adjacent to the extension cart 6 couples or connects the roller blind sheet 130 to the extension cart 6.

In some implementations, as the extension cart 6 is pushed or otherwise moves along the track 8, the extension rod 7 on the extension cart 6 pulls and extends the roller blind sheet 130 over an angled architectural opening to which the roller blind assembly 100 is attached.

Similarly, in some implementations, as the roller tube 5 is rotated or otherwise turns to retract the roller blind sheet 130, the roller blind sheet 130 is pulled or otherwise retracted from over the angled architectural opening. In some implementations, as the roller blind sheet 130 is retracted, the roller blind sheet 130 pulls the extension rod 7 by the connection to the sleeve 1*b*, which thereby pulls the extension cart 6 toward the roller tube 5.

As shown in FIGS. 14*a* and 14*b*, in some implementations, the extension cart 6 comprises two openings ("holes") 6*a*, 6*b*. In some implementations, the two rods 8*a*, 8*b* that form the track 8 for the extension cart 6 fit respectively into the two holes 6*a*, 6*b* in the extension cart 6.

In some implementations, the fit between the two holes 6*a*, 6*b* in the extension cart 6 and the track rods 8*a*, 8*b* is tight enough to prevent any excess movement of the extension cart 6 away from the track 8. In some implementations, the fit between the holes 6*a*, 6*b* and the rods 8*a*, 8*b* is loose enough to allow the extension cart 6 to slide smoothly along the track rods 8*a*, 8*b*.

In some implementations, the shape of the extension cart 6 is designed to hold the extension rod 7 in a vertical position. As shown in FIGS. 11 and 14*a*-14*b*, in some implementations, the extension cart 6 comprises a hollow cylinder 6*c* on the top side of the extension cart 6. In some implementations, the hollow portion of the cylinder 6*c* is sized to snuggly hold the extension rod 7 to thereby couple the extension rod 7 and the extension cart 6 together.

In some implementations, movement of the extension cart 6 therefore causes corresponding movement of the extension rod 7. In some implementations, movement of the extension rod 7 therefore causes corresponding movement of the extension cart 6.

As introduced above, in some implementations, the roller blind assembly 100 may be rotated bottom side 2*b* up for use in an angled architectural opening with an angled bottom side instead of an angled top side. In some implementations, for such rotated assembly 100, additional ways of attachment can be used to prevent gravity from detaching the extension rod 7 from the extension cart 6 and from pulling the roller blind sleeve 1*b*, 1*e* off of the extension rod 7. In some implementations, such additional ways of attachment may include various ways, such as by glue, screw(s) or set screw(s).

As shown in FIG. 14*b*, in some implementations, the extension cart 6 comprises a cutout 6*d* on the bottom of the extension cart 6. In some implementations, the cutout 6*d* is wider at the opening and narrows to slightly wider than the engaging extension 9*a* at the other end of the cutout 6*d*.

In some implementations, the cutout 6*d* guides the engaging extension 9*a* to engage the extension cart 6 when the chain 9 is moved in the direction to push the extension cart 6 toward the extended side 2*c* of the roller blind assembly 100. In some implementations, the engaging extension 9*a* is then housed into the extension cart 6 when the engaging extension 9*a* reaches the closed end of the cutout 6*d*.

In some implementations, once the engaging extension 9*a* is housed into the extension cart 6 by the cutout 6*d*, further movement of the chain 9 to extend the roller blind sheet 130 pushes the extension cart 6 toward the extended side 2*c* of the roller blind assembly 100. In some implementations, the roller blind sheet 130 is thereby pulled toward the extended side 2*c* of the roller blind assembly 100 by the coupling of the roller blind sheet 130 to the extension cart 6 through the connection of the sleeve 1*b*, 1*e* and the extension rod 7.

In some implementations, the engaging extension 9*a* slides out of the extension cart 6 when the chain 9 is moved in the other direction toward the retracted side 2*a* of the roller blind assembly 100. In some implementations, the engaging extension 9*a* can then travel away from the extension cart 6 without further affecting the position of the extension cart 6.

As shown in FIGS. 14*a* and 14*b*, in some implementations, the extension cart 6 also comprises a shelf 6*e*.

As shown in FIGS. 11 and 14*a*, in some implementations, the shelf 6*e* connects an extension piece or limit switch extension 17 of the extension assembly 160 to the extension cart 6. In some implementations, the limit switch extension 17 interacts with limit switches 37, 39, described below.

In some implementations, the extension 17 is similar to, e.g. shaped like, a beam that has wider portions 17*a*, 17*b* on each end respectively.

In some implementations, the wider portions 17*a*, 17*b* assist in the interaction between the limit switch extension 17 and the limit switches 37, 39 respectively.

In some implementations, the length of the extension 17 on each end is based respectively on the location of the limit switches 37, 39 relative to the extension cart 6 when the roller blind sheet 130 is in the fully extended or fully retracted position.

In some implementations, the shelf 6*e* has holes that align with holes in the limit switch extension 17 for the connection of the limit switch extension 17 to the extension cart 6.

In some implementations, the extension 17 can be connected to the extension cart 6 at the shelf 6*e* in various ways, such as by nuts and bolts, screws, or adhesive.

In some implementations, the extension 17 and the extension cart 6 may be integrated as a single part of the extension assembly 160.

Figure 15A:
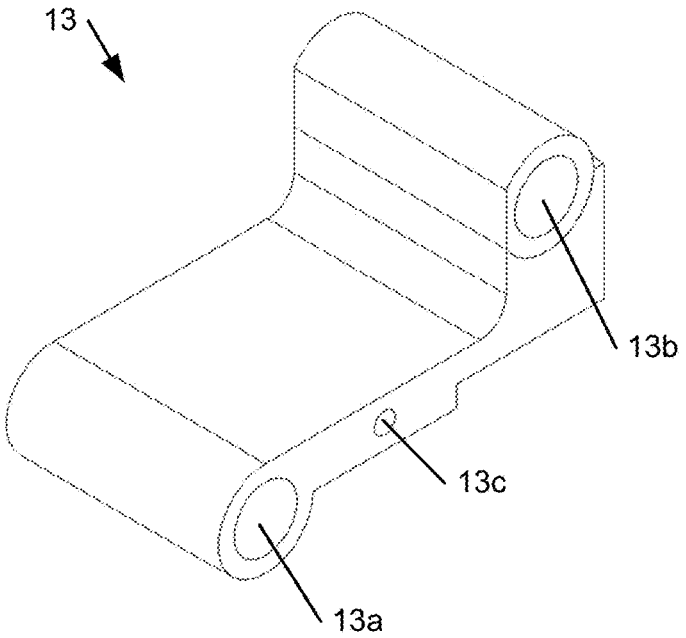
FIGS. 15*a* and 15*b* illustrate side and bottom perspective views respectively of the retraction assembly of the roller blind assembly according to the present disclosure.
Figure 15B:
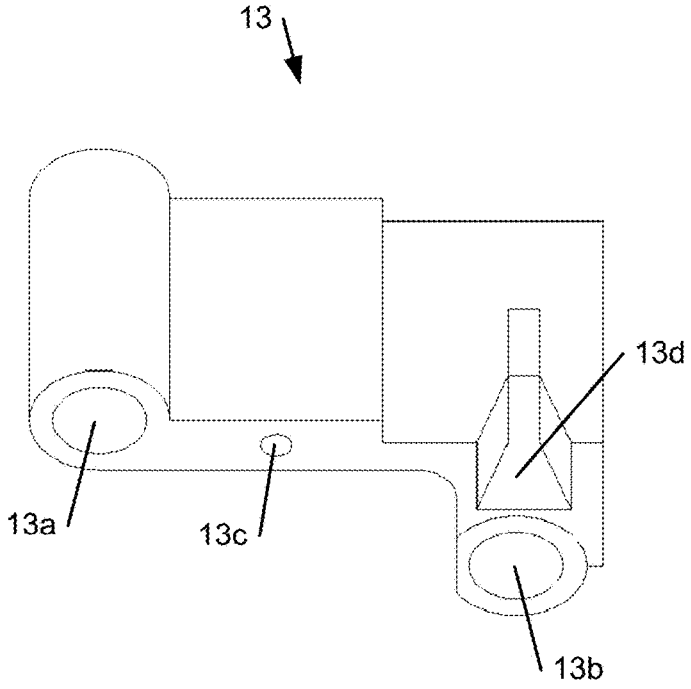

As shown in FIGS. 11 and 15*a*-15*b*, in some implementations, the retraction assembly 170 comprises a substantially rectangular prism shaped body 13 having a pair of openings 13*a*, 13*b* extending therethrough, as described herein. In some implementations, the body 13 has any other suitable shape.

As shown in FIG. 1*c*, in some implementations, the retraction assembly 170 is moveably connected to the retraction track 14. In some implementations, the retraction assembly 170 can move along the retraction track 14 between the first side 2*a* and the second side 2*c* of the frame 110.

In some implementations, the retraction assembly 170 is engageably coupleable to the chain 9 by the body 13 of the retraction assembly 170. In some implementations, a movement of the second engaging extension 9*b* toward the retraction assembly 170 by a movement of the chain 9 causes the second engaging extension 9*b* to engage the body 13 of the retraction assembly 170. In some implementations, the movement of the second engaging extension 9*b* causes the chain 9 to couple to the retraction assembly 170 to move the retraction assembly 170 along the retraction track 14.

As shown in FIG. 1*c*, in some implementations, the retraction assembly 170 is coupled to the tube 5 of the roller tube assembly 120 by a tether 16. In some implementations, the tether 16 is connected to the body 13 of the retraction assembly 170 and to the tube 5.

In some implementations, the tether 16 rolls up around the tube 5 as the roller blind sheet 130 is unrolled and extended from the tube 5. In some implementations, as the tether 16 rolls up around the tube 5, the tether 16 moves the retraction assembly 170 towards the tube 5 and the first side 2*a* of the frame 110.

In some implementations, the roller blind sheet 130 retracts and rolls up around the tube 5 as the tether 16 is unrolled and extended from the tube 5 by a movement of the retraction assembly 170 along the retraction track 14 by the chain 9.

As shown in FIGS. 11 and 15*a*-15*b*, in some implementations, the retraction assembly 170 comprises a retraction cart 13. In some implementations, the retraction cart 13 is connected to the tether 16 on the other end from the connection of the tether 16 to the roller tube tether attachment 23.

As shown in FIG. 11, in some implementations, the retraction cart 13 is moveably connected to the track 14 of the track assembly 150. In some implementations, the retraction cart 13 rides along the track 14.

As shown in FIGS. 15*a* and 15*b*, in some implementations, the retraction cart 13 comprises two openings ("holes") 13*a*, 13*b*. In some implementations, the retraction track rods 14*a*, 14*b* fit respectively into the two holes 13*a*, 13*b* in the retraction cart 13.

In some implementations, the fit between the two holes 13*a*, 13*b* in the retraction cart 13 and the retraction track rods 14*a*, 14*b* is tight enough to prevent any excess movement of the retraction cart 13 from the retraction track 14. In some implementations, the fit between the holes 13*a*, 13*b* and the rods 14*a*, 14*b* is loose enough to allow the retraction cart 13 to slide smoothly along the retraction track 14.

As shown in FIGS. 15*a* and 15*b*, in some implementations, the retraction cart 13 also comprises a hole 13*c* through the cart 13. In some implementations, the hole 13*c* is sized to allow the tether 16 to thread through the hole to connect the tether 16 to the retraction cart 13.

In some implementations, the tether 16 can be connected to the retraction cart 13 through the hole 13*c* in various ways, such as by a knot, a clip end, or a washer that is wider than the hole 13*c*.

As shown in FIG. 15*b*, in some implementations, the retraction cart 13 comprises a cutout 13*d* on the bottom of the retraction cart 13. In some implementations, the cutout 13*d* is wider at the opening and narrows to slightly wider than the engaging extension 9*b* at the other end of the cutout 13*d*.

In some implementations, the cutout 13*d* guides the engaging extension 9*b* to engage the retraction cart 13 when the chain 9 is moved in the direction to push the retraction cart 13 toward the extended side 2*c* of the roller blind assembly 100. In some implementations, the engaging extension 9*b* is then housed into the retraction cart 13 when the engaging extension 9*b* reaches the closed end of the cutout 13*d*.

In some implementations, once the engaging extension 9*b* is housed into the retraction cart 13 by the cutout 13*d*, further movement of the chain 9 to retract the roller blind sheet 130 pushes the retraction cart 13 toward the extended side 2*c* of the roller blind assembly 100. In some implementations, the tether 16 is thereby pulled by the retraction cart 13 and unwound from the tether attachment 23.

In some implementations, the unwinding of the tether from the tether attachment 23 causes the tether attachment 23, the roller tube bottom attachment 22, and the roller tube 5 to rotate in unison. In some implementations, the roller blind sheet 130 is thereby wound onto the roller tube 5 to retract the roller blind sheet 130.

In some implementations, the chain attachment 9*b* slides out of the retraction cart 13 when the chain 9 is moved in the other direction toward the retracted side 2*a* of the roller blind assembly 100. In some implementations, the chain attachment 9*b* can then travel away from the retraction cart 13 without further affecting the position of the retraction cart 13.

In some implementations, the tether 16 comprises a string. In some implementations, the tether 16 comprises a cord. In some implementations, the tether 16 comprises a wire. In some implementations, the tether 16 comprises a cable.

In some implementations, the tether 16 comprises any other suitable component.

In some implementations, the tether 16 is strong enough, e.g. has sufficient tensile strength, to pull the retraction assembly 170 toward the roller tube 5 as the roller blind sheet 130 is extended. In some implementations, the tether 16 is also strong enough to cause the roller tube 5 to rotate and retract the roller blind sheet 130 onto the roller tube 5 as the retraction assembly 170 is pushed away from the roller tube 5.

As shown in FIGS. 7*a* and 7*b*, in some implementations, the tether 16 is flexible enough to wrap snuggly around the tether attachment 23 or unwind from the tether attachment 23 as the roller tube 5 rotates. In some implementations, the tether 16 is also flexible enough to remain wound sufficiently tight around the tether attachment 23 when the roller blind assembly 100 is stationary and there is no force being applied to either of the assemblies 160, 170 or to the roller blind sheet 130.

In some implementations, the tether 16 can be composed of various materials with the foregoing properties, such as string, cord, wire, or flexible cabling.

As shown in FIGS. 6 and 16*a*-16*b*, in some implementations, the motor assembly 180 comprises a motor 32. In some implementations, the motor assembly 180 is attached to the frame 110.

In some implementations, the motor 32 is coupled to the chain 9, such as described further below, so that the motor 32 can cause the chain 9 to move along the horizontal loop.

In some implementations, the motor 32 is operable to move the chain 9 in a first direction that moves the first engaging extension 9*a* toward the extension assembly 160. In some implementations, the motor 32 can move the first engaging extension 9*a* to engage the extension assembly 160. In some implementations, the motor 32 can move the first engaging extension 9*a* to couple the chain 9 to the extension assembly 160. In some implementations, the motor 32 can move the first engaging extension 9*a* to thereby move the extension assembly 160 along the extension track 8.

In some implementations, the motor 32 is operable to move the chain 9 in a second direction that moves the second engaging extension 9*b* toward the retraction assembly 170. In some implementations, the motor 32 can move the second engaging extension 9*b* to engage the retraction assembly 170. In some implementations, the motor 32 can move the second engaging extension 9*b* to couple the chain 9 to the retraction assembly 170. In some implementations, the motor 32 can move the second engaging extension 9*b* to thereby move the retraction assembly 170 along the retraction track 14.

As shown in FIGS. 16*a* and 16*b*, in some implementations, the motor assembly 180 further comprises a motor shaft attachment 34. In some implementations, the motor shaft attachment 34 extends the rotation of the motor shaft to the second sprocket 30, described above with respect to the chain assembly 140.

In some implementations, the sprocket 30 and the attachment 34 are connected together and rotate in unison with the motor 32, also connected to the attachment 34, at the same angular velocity.

As shown in FIG. 16*b*, in some implementations, the motor shaft extension 34 comprises a shaft with a shelf or flange 34*a* on the top side. In some implementations, the flange 34*a* comprises holes that align with a motor coupling 33.

In some implementations, the motor shaft flange 34*a* can be connected to the motor coupling 33 in various ways, such as by nuts and bolts, screws, or rivets.

In some implementations, the motor coupling 33 can be connected to the shaft of the motor 32 in various ways, such as by set screws.

In some implementations, the shaft of the extension 34 is sized to provide sufficient torsional strength to transfer the torque of the motor 32 to the sprocket 30, which can thereby move the chain 9 by the sprocket 30.

In some implementations, the shaft of the extension 34 is long enough and narrow enough to position the motor 32 out of the path of the extension cart 6 and the attached roller blind sheet 130. In some implementations, the shaft of the extension 34 is also long enough and narrow enough to allow a further length of travel of the extension assembly 160 and the attached roller blind sheet 130 toward the extended side 2*c*.

In some implementations, the bottom portion of the extension 34*b* fits snuggly in the center of the sprocket 30.

In some implementations, the sprocket 30 can be tightened to the bottom portion of the extension 34*b* in various ways, such as with set screw(s).

In some implementations, the motor 32 may be an alternating current (AC) or direct current (DC) motor. In some implementations, the motor 32 can be any other suitable type of motor.

In some implementations, the motor 32 can be powered in various ways, such as by a battery, a battery pack, or an AC power source, which may include an AC/DC power adapter or inverter.

In some implementations, the motor 32 has a bi-directional or reversible rotation.

In some implementations, the motor 32 is attached to the frame extended side 2*c* in a position that does not interfere with other components of the roller blind assembly 100 such as the chain 9, engaging extensions 9*a*, 9*b*, carts 6, 13, or the tracks 8, 14.

As shown in FIGS. 16*a* and 16*b*, in some implementations, the motor 32 may attach to the frame extended side 2*c* by a mounting bracket 35. In some implementations, the motor 32 may attach to the roller assembly frame 110 in any other suitable way.

In some implementations, as the motor 32 rotates in the applicable direction, e.g. clockwise or counter-clockwise, the motor 32 extends or retracts the roller blind sheet 130 through the various connections and operations of the components of the roller blind assembly 100 described herein. That is, in some implementations, the motor 32 allows the automated operation of the assembly 100 to extend or retract the roller blind sheet 130.

However, in some implementations, the operation of the roller blind assembly 100 may be performed manually or in any other suitable manner. For example, in some implementations, a crank, handle, or other manual control (not shown) may be connected to the assembly 100 instead of the motor 32, as described herein, to allow the manual operation of the assembly 100 to extend or retract the roller blind sheet 130.

As shown in FIG. 11, in some implementations, the roller blind assembly 100 further comprises a first limit switch 37 and a second limit switch 39. In some implementations, the first limit switch 37 and the second limit switch 39 are each attached to the frame 110.

In some implementations, the first limit switch 37 is positioned adjacent to the extension track 8 to be activated by the extension assembly 160. In some implementations, the first limit switch 37 is positioned to be activated when the extension assembly 160 has been moved along the extension track 8 to fully extend the roller blind sheet 130 across the frame 110.

In some implementations, the first limit switch 37 when activated causes the motor 32 to stop moving the extension assembly 160 along the extension track 8.

In some implementations, the second limit switch 39 is positioned adjacent to the extension track 8 to also be activated by the extension assembly 160. In some implementations, the second limit switch 39 is positioned to be activated when the extension assembly 160 has been moved along the extension track 8 by the roller blind sheet 130 being fully retracted from across the frame 110.

In some implementations, the second limit switch 39 when activated causes the motor 32 to stop moving the retraction assembly 170 along the retraction track 14.

In some implementations, the limit switches 37, 39 prevent the motor 32 from continuing to drive the chain 9 after the roller blind sheet 130 has been fully extended or fully retracted by the motor 32. For example, in some implementations, the limit switches 37, 39 send a signal to a motor controller 36, described below, to stop the operation of the motor 32 after the roller blind sheet 130 has been fully extended or fully retracted.

In some implementations, the limit switches 37, 39 may be any suitable limit switch that can be used for the roller blind assembly 100. In some implementations, other suitable switches can be used instead or in addition to the limit switches 37, 39, such as a switch or other component that senses the operation of the roller tube 5 with respect to the position of the roller blind sheet 130.

Figure 17A:
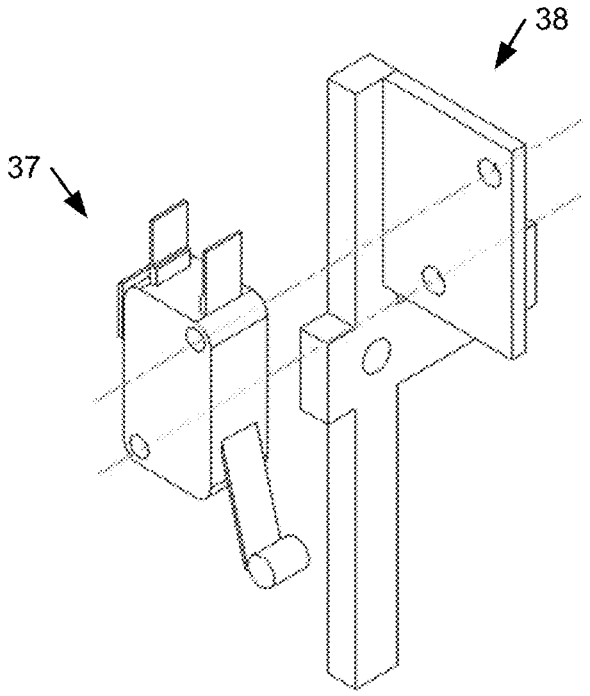
FIGS. 17*a* and 17*b* illustrate a perspective view of the retracted side limit switch and bracket and of the extended side limit switch and bracket respectively of the roller blind assembly according to the present disclosure.
Figure 17B:
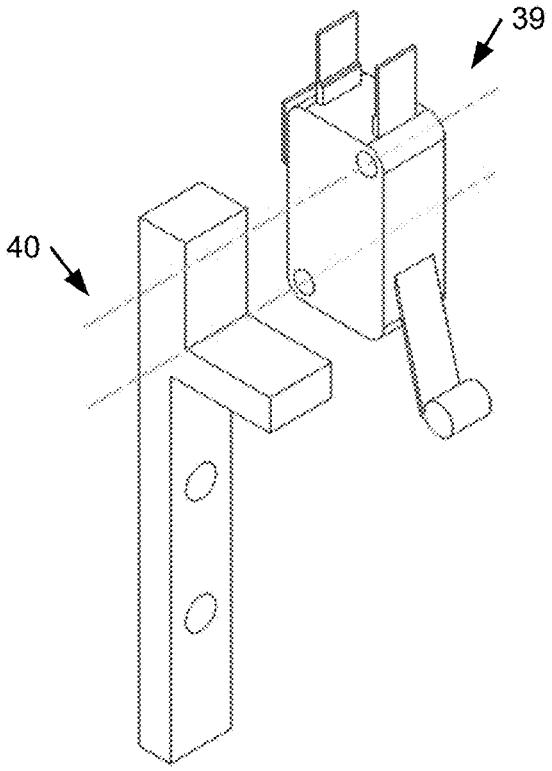

As shown in FIGS. 17*a* and 17*b*, in some implementations, the roller blind assembly 100 comprises limit switch brackets 38, 40. In some implementations, the brackets 38, 40 are used to mount the limit switches 37, 39 in the roller blind assembly 100.

In some implementations, the brackets 38, 40 are used to mount the limit switches 37, 39 respectively on the retracted side 2*a* and extended side 2*c* of the roller blind assembly 100.

In some implementations, the brackets 38, 40 are designed to position the limit switches 37, 39 to work and interact with the extension assembly 160 relative to the position of the roller blind sheet 130, such as fully extended or retracted.

In some implementations, the brackets 38, 40 are also designed to position the limit switches 37, 39 to prevent interference between the limit switches 37, 39, the brackets 38, 40, and other components of the roller blind assembly 100.

In some implementations, the brackets 38, 40 can be attached to the frame of the roller blind assembly 100 in various ways, such as by screws, nails, or adhesive.

As introduced above and shown in FIG. 14*a*, in some implementations, the extension assembly 160 comprises a limit switch extension 17 attached to the extension cart shelf 6*e*. In some implementations, the extension 17 interacts, e.g. engages, with the limit switches 37, 39 during operation of the roller blind assembly 100 as described herein.

As shown in FIG. 6, in some implementations, the roller blind assembly 100 further comprises a motor controller 36. In some implementations, the motor controller 36 is attached to the frame 110.

In some implementations, the motor controller 36 can be mounted in any suitable position on the frame 110 of the roller blind assembly 100 that does not interfere with other parts of the assembly 100, such as the extension and retraction of the roller blind sheet 130. For example, in some implementations, the motor controller 36 is mounted to the frame extended side 2*c*.

In some implementations, the motor controller 36 is connected to the motor 32 to control the operation of the motor 32.

In some implementations, the motor controller 36 may comprises any suitable component to control the operation of the motor 32 and thereby the roller blind assembly 100.

In some implementations, the motor controller 36 allows a manual operation of the motor 32. In some implementations, the motor controller 36 allows an automatic operation of the motor 32.

In some implementations, the motor controller 36 allows a local operation of the motor 32. In some implementations, the motor controller 36 allows a remote operation of the motor 32.

In some implementations, the motor controller 36 allows such operation of the motor 32 to extend or retract the roller blind sheet 130.

For example, in some implementations, the motor controller 36 can be operated by a remote control. As another example, in some implementations, the motor controller 36 can be operated by a wired switch configuration.

In some implementations, the motor controller 36 can control the motor 32 to operate, i.e. rotate, in both directions.

In some implementations, the motor controller 36 uses the limit switches 37, 39, described above, to control the motor 32. For example, in some implementations, the motor controller 36 uses the limit switches 37, 39 to start or stop the motor 32 when the roller blind sheet 130 is in a certain position, such as fully extended or fully retracted.

As described above, in some implementations, the motor 32 may be powered by various power sources, such as a battery or battery pack. As shown in FIG. 6, in some implementations, the roller blind assembly 100 may further comprise a power supply shelf (also referred to herein as a battery shelf) 42 for supporting such a battery or pack. In some implementations, the power supply shelf 42 is attached to the frame 110.

In some implementations, the power supply shelf 42 stabily supports a power supply 41, such as a battery or battery pack, of the roller blind assembly 100 that powers the motor 32.

Figure 18A:
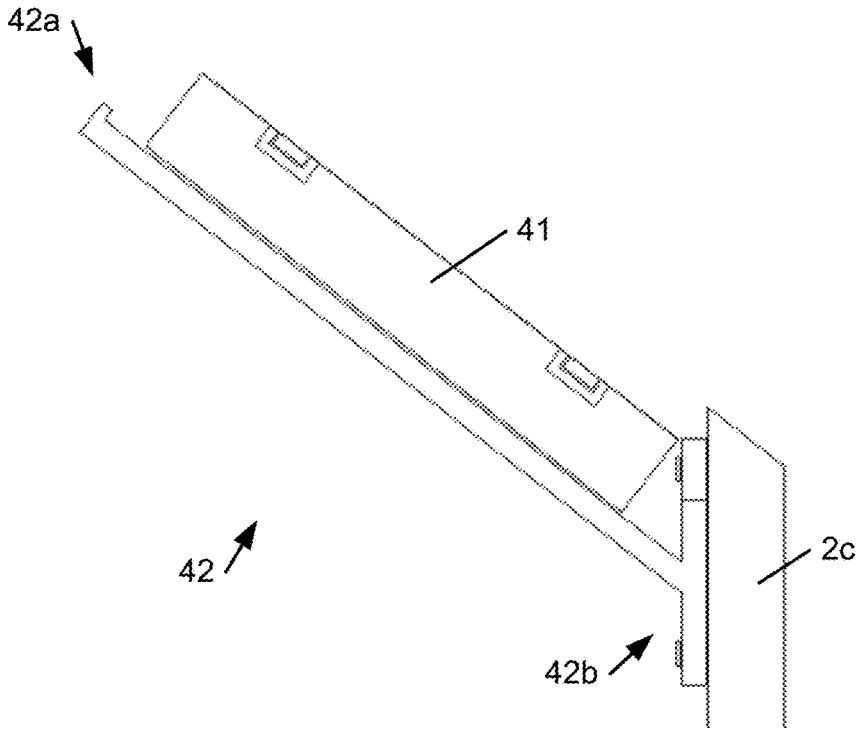
FIGS. 18*a* and 18*b* illustrate a side view and a perspective view respectively of the power supply shelf of the roller blind assembly according to the present disclosure.
Figure 18B:
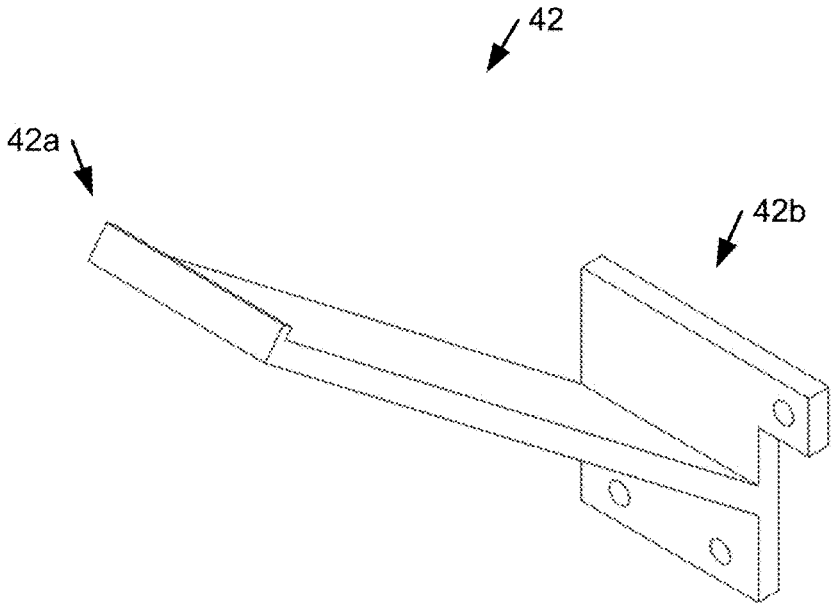

As shown in FIGS. 18*a* and 18*b*, in some implementations, the battery shelf 42 comprises a flange 42*b* for the positioning and attachment of the shelf 42 to the roller blind assembly 100, such as to the frame extended side 2*c*.

In some implementations, the shelf 42 also comprises a raised edge 42*a* that prevents the battery 41 from sliding off the battery shelf 42.

In some implementations, the shelf 42 provides a position for the battery 41 in the assembly that does not interfere with other parts of the assembly, such as the movement of the roller blind sheet 130 and connected components.

In some implementations, the shelf 42 may also minimize the visibility of the battery pack 41 positioned in the roller blind assembly 100, e.g. for aesthetic appearance.

In some implementations, the shelf 42 can be attached to the frame of the roller blind assembly 100 in various ways, such as by screws, nails, or adhesive.

In some implementations, the shelf 42 attaches to the frame extended side 2*c* so that the battery 41 is oriented at the same or a similar angle as the top side of the angled architectural opening to which the roller blind assembly 100 is installed. In some implementations, this allows the battery shelf 42 and the battery 41 to be positioned behind the top outer frame side 3*d*, if the outer frame 115 is included in the roller blind assembly 100.

As introduced above, in some implementations, the roller blind assembly 100 may be rotated bottom side 2*b* up for use in an angled architectural opening with an angled bottom side instead of an angled top side. In some implementations, for such rotated assembly 100, the raised edge 42*a* of the battery shelf 42 is positioned on the bottom of the shelf 42. In some implementations, for such rotated assembly 100, the battery 41 is positioned on the bottom of the battery shelf 42 to keep the battery 41 in position and behind the outer frame top side 3*d* if included in the assembly 100.

Although the components of the roller blind assembly 100 are described herein as attached, coupled, or otherwise connected to the frame 110, in some implementations, one or more of the components may not be connected as such to the frame 110. For example, in some implementations, one or more of the components of the roller blind assembly 100 may be attached or otherwise connected to the angled architectural opening, e.g. to the frame thereof, to which the roller blind assembly 100 is installed. In some implementations, all of the components of the roller blind assembly 100 may be attached or otherwise connected to the angled architectural opening to which the roller blind assembly 100 is installed instead of being attached or otherwise connected to the frame 110, which can thereby be omitted from the assembly 100.

Furthermore, in some implementations, the roller blind assembly 100 may be permanently or temporarily installed to an angled architectural opening. For example, in some implementations, the roller blind assembly 100 may be removable and reinstallable to the angled architectural opening by detaching and reattaching respectively the frame 110 from/to the angled architectural opening with the other components attached or otherwise connected to the frame 110.

In some implementations, the roller blind assembly 100 can have any suitable dimensions.

In some implementations, the roller blind assembly 100 is composed of any suitable materials.

In some implementations, the roller blind assembly 100 can have any suitable appearance.

Figure 20:
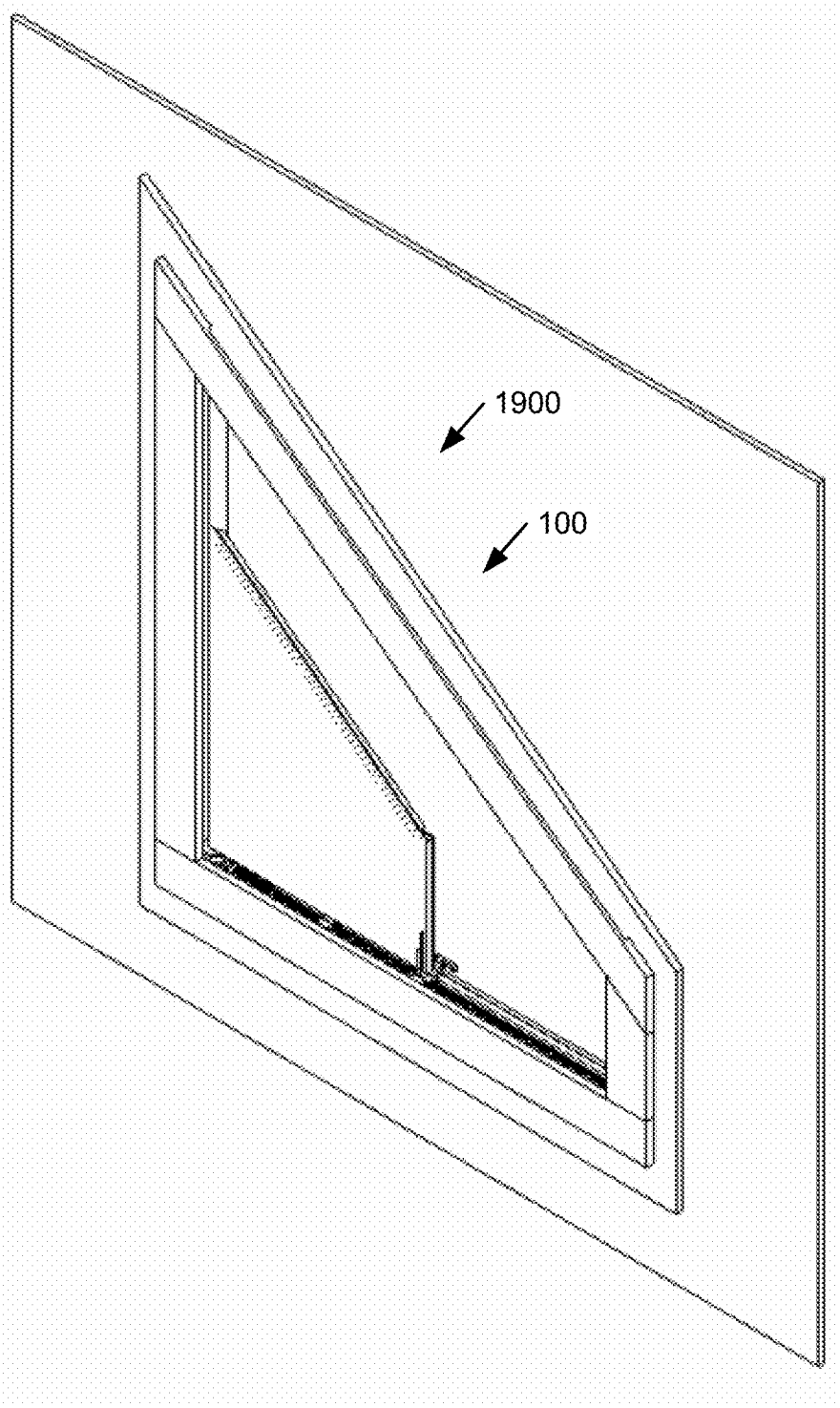
FIG. 20 illustrates a front side or interior side perspective view of the roller blind assembly according to the present disclosure installed in the example angled architectural opening.

In some implementations, an example method of using the roller blind assembly 100 comprises installing the roller blind assembly 100 to a window having a modified rectangular shape, as described above. In some implementations, the roller blind assembly 100 is installed by attaching the frame 110 of the roller blind assembly 100 to the window (e.g., the frame of the window). For example, FIG. 20 illustrates a front side or interior side perspective view of the roller blind assembly 100 installed in an example angled architectural opening 1900 such as a window, as described above.

In some implementations, the frame 110 is attached so that the frame 110 fully fits the perimeter of the window. In some implementations, the frame 110 is attached so that the roller blind sheet 130 fully covers the opening of the window when the roller blind sheet 130 is fully extended across the opening.

For example, in some implementations, the frame 110 is attached so that the first side 2*a* of the frame 110 is adjacent to the first side of the window, the second side 2*c* of the frame 110 is adjacent to the second side of the window, and the bottom side 2*b* of the frame 110 is adjacent to the bottom side of the window.

In some implementations, the method further comprises covering the opening of the window with the roller blind sheet 130 by operating the motor 32 to move the chain 9 in a first direction, as described above.

In some implementations, the first engaging extension 9*a* is thereby moved toward the extension assembly 160. In some implementations, the extension assembly 160 is thereby engaged by the first engaging extension 9*a*. In some implementations, the chain 9 is thereby coupled to the extension assembly 160.

In some implementations, the extension assembly 160 is thereby moved along the extension track 8. In some implementations, the roller blind sheet 130 is thereby unrolled from the tube 5 and extended horizontally across the opening of the window. In some implementations, the opening of the window is thereby covered by the roller blind sheet 130.

In some implementations, the tether 16 is also thereby rolled up around the tube 5 as the roller blind sheet 130 is unrolled and extended from the tube 5.

In some implementations, the method further comprises uncovering the roller blind sheet 130 from the opening of the window by operating the motor 32 to move the chain 9 in a second direction, as described above.

In some implementations, the second engaging extension 9*b* is thereby moved toward the retraction assembly 170. In some implementations, the retraction assembly 170 is thereby engaged by the second engaging extension 9*b*. In some implementations, the chain 9 is thereby coupled to the retraction assembly 170.

In some implementations, the retraction assembly 170 is thereby moved along the retraction track 14. In some implementations, the tether 16 is thereby unrolled and extended from the tube 5 by the retraction assembly 170. In some implementations, the roller blind sheet 130 is thereby retracted and rolled up around the tube 5 by the tether 16 unrolling from the tube 5. In some implementations, the roller blind sheet 130 is thereby uncovered from the opening of the window.

In some implementations, an example method of operation of the roller blind assembly 100 comprises rotating the motor 32 in the applicable direction to extend the roller blind sheet 130. In some implementations, the rotation of the motor 32 causes the extended side sprocket 30 to rotate by the rotation of the motor shaft extension 34. In some implementations, the rotation of the sprocket 30 causes the attached chain 9 to travel in the associated direction in the path around the two cart tracks 8, 14.

In some implementations, as the chain 9 travels, the engaging extensions 9*a*, 9*b* travel with the chain 9. In some implementations, when the engaging extension 9*a* reaches the extension cart 6, the engaging extension 9*a* slides into the cutout 6*d* on the extension cart 6 until it reaches the end of the cutout 6*d*.

In some implementations, as the chain 9 continues to travel, the engaging extension 9*a* pushes the extension cart 6 in the extend direction of the assembly 100. In some implementations, as the extension cart 6 is pushed in the extend direction, the roller blind sheet 130 is pulled by the extension cart 6 at the coupling of the extension cart rod 7 inserted into the roller blind sleeve 1*b*.

In some implementations, as the roller blind sheet 130 is moved by the extension cart 6, it unwinds from the roller tube 5. In some implementations, the unwinding of the roller blind sheet 130 from the roller tube 5 causes the rotation of the roller tube 5. In some implementations, the rotation of the roller tube 5 causes rotation of the roller tube bottom attachment 22 and attached tether attachment 23

In some implementations, the rotation of the tether attachment 23 causes the tether 16 to wind onto the tether attachment 23. In some implementations, as the tether 16 is wound onto the tether attachment 23, the tether 16 pulls the retraction cart 13 toward the retracted side of the assembly 100.

In some implementations, an example method of operation of the roller blind assembly 100 comprises rotating the motor 32 in the applicable direction to retract the roller blind sheet 130. In some implementations, the rotation of the motor 32 causes the extended side sprocket 30 to rotate by the rotation of the motor shaft extension 34. In some implementations, the rotation of the sprocket 30 causes the attached chain 9 to travel in the associated direction in the path around the two cart tracks 8, 14.

In some implementations, as the chain 9 travels, the engaging extensions 9*a*, 9*b* on the chain 9 travel with the chain 9. In some implementations, the engaging extension 9*a* slides out of the cutout 6*d* on the extension cart 6 and travels away from the extension cart 6.

In some implementations, the chain attachment 9*b* travels towards the retraction cart 13. In some implementations, when the chain attachment 9*b* reaches the retraction cart 13, the attachment 9*b* slides into the cutout 13*d* on the retraction cart 13 until it reaches the end of the cutout 13*d*.

In some implementations, as the chain 9 continues to travel, the attachment 9*b* pushes the retraction cart 13 away from the roller tube 5 in the extend direction of the assembly 100.

In some implementations, as the retraction cart 13 is moved, the tether 16 is pulled by the retraction cart 13 and unwinds from the tether attachment 23. In some implementations, as the tether 16 unwinds from the tether attachment 23, this causes the roller tube 5 to rotate in the corresponding direction.

In some implementations, the rotation of the roller tube 5 causes the roller blind sheet 130 to retract and wind onto the roller tube 5. In some implementations, as the roller blind sheet 130 retracts and winds onto the roller tube 5, the extension cart 6 is pulled toward the retracted side of the assembly 100 at the coupling of the extension cart rod 7 inserted into the roller blind sleeve 1*b*.

As described above, in some implementations, the chain 9 may comprise a single engaging extension in place of the two extensions 9*a*, 9*b*. In some implementations, such single engaging extension can provide essentially the same or substantially similar function as the two extensions 9*a*, 9*b* such as described in the above example methods of use and operation of the roller blind assembly 100.

For example, in some implementations, the operation of the roller blind assembly 100 with such single engaging extension may slightly increase the amount of time for the engagement and coupling of the single engaging extension to the extension cart/assembly 6, 160 or the retraction cart/assembly 13, 170 during the operation of the assembly 100.

As another example, in some implementations, the operation of the roller blind assembly 100 with such single engaging extension may slightly increase the amount of time for the transition between the extension and the retraction of the roller blind sheet 130 during the operation of the assembly 100.

The figures, including photographs and drawings, comprised herewith may represent one or more implementations of the roller blind assembly.

Details shown in the figures, such as dimensions, descriptions, etc., are exemplary, and there may be implementations of other suitable details according to the present disclosure.

Reference throughout this specification to "an embodiment" or "implementation" or words of similar import means that a particular described feature, structure, or characteristic is comprised in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations may be depicted in the drawings in a particular order, this should not be understood as requiring that such operations be performed in the particular order shown or in sequential order, or that all illustrated operations be performed, to achieve desirable results.

The invention claimed is:

1. A roller blind assembly for covering the opening of a window having a modified rectangular shape wherein a top side of the window extends diagonally downward from a first side of the window to a second side of the window so that the top side of the window is non-perpendicular to the first side of the window and the second side of the window and is non-parallel to a bottom side of the window, the roller blind assembly comprising:

a frame comprising a first side, a second side, and a bottom side, wherein:

the first side of the frame extends vertically between a first side bottom end and a first side top end;

the second side of the frame extends vertically between a second side bottom end and a second side top end;

the bottom side of the frame extends horizontally between and is connected respectively to the first side bottom end and the second side bottom end;

the first side of the frame is longer than the second side of the frame; and the shape of the frame defined by the first side of the frame, the second side of the frame, and the bottom side of the frame corresponds to the modified rectangular shape of the window so that the frame can fully fit within or adjacent to the perimeter of the window by the first side of the frame extending parallel to the first side of the window, the second side of the frame extending parallel to the second side of the window, and the bottom side of the frame extending parallel to the bottom side of the window;

a roller tube assembly attached to the frame and comprising a cylindrical tube extending vertically adjacent to the first side of the frame and rotatably attached to the frame so that the tube is rotatable about a longitudinal center of the tube;

a roller blind sheet comprising a top edge, a bottom edge, a first side edge, and a second side edge that define a shape of the roller blind sheet that corresponds to the modified rectangular shape of the window so that the roller blind sheet covers the opening of the window, wherein:

the first edge of the roller blind sheet is longer than the second side edge;

the first side edge of the roller blind sheet is attached to the tube of the roller tube assembly so that the roller blind sheet can be rolled up around the tube and can be unrolled and extended from the tube to respectively uncover and cover the opening of the window; and the top edge of the roller blind sheet is configured to horizontally support the roller blind sheet when extended from the tube and to allow the roller blind sheet to roll up around the tube when retracted;

a chain assembly attached to the frame and comprising a chain extending in and moveable along a horizontal loop between the first side of the frame and the second side of the frame adjacent to the bottom side of the frame, wherein the chain comprises a first engaging extension and a second engaging extension that each comprise a rectangular shaped plate attached to and extending from the chain;

a track assembly attached to the frame and comprising an extension track and a retraction track, wherein the extension track and the retraction track each comprise a pair of rods extending between the first side and the second side of the frame;

an extension assembly comprising a rectangular prism shaped body having a pair of openings extending therethrough and a rod extending therefrom, wherein:

the extension assembly is moveably connected to the extension track through the openings of the extension assembly so that the extension assembly can move along the extension track between the first side of the frame and the second side of the frame;

the extension assembly is engageably coupleable to the chain by the body of the extension assembly so that a movement of the first engaging extension toward the extension assembly by a movement of the chain causes the first engaging extension to engage the body of the extension assembly and couple the chain to the extension assembly to move the extension assembly along the extension track; and the extension assembly is connected to the roller blind sheet by the rod of the extension assembly adjacent to the second side edge of the roller blind sheet so that a movement of the extension assembly along the extension track by the chain causes an unrolling and extending of the roller blind sheet from the tube and horizontally across the frame;

a retraction assembly comprising a rectangular prism shaped body having a pair of openings extending therethrough, wherein:

the retraction assembly is moveably connected to the retraction track through the openings of the retraction assembly so that the retraction assembly can move along the retraction track between the first side and the second side of the frame;

the retraction assembly is engageably coupleable to the chain by the body of the retraction assembly so that a movement of the second engaging extension toward the retraction assembly by a movement of the chain causes the second engaging extension to engage the body of the retraction assembly and couple the chain to the retraction assembly to move the retraction assembly along the retraction track; and the retraction assembly is coupled to the tube of the roller tube assembly by a tether that is connected to the body of the retraction assembly and to the tube, wherein the tether is configured to roll up around the tube as the roller blind sheet is unrolled and extended from the tube and unroll and extend from the tube by a movement of the retraction assembly along the retraction track by the chain, and wherein the roller blind sheet is configured to retract and roll up around the tube as the tether is unrolled and extended from the tube by a movement of the retraction assembly along the retraction track by the chain; and a motor assembly attached to the frame and comprising a motor, wherein:

the motor is coupled to the chain so that the motor can cause the chain to move along the horizontal loop;

the motor is operable to move the chain in a first direction that moves the first engaging extension toward the extension assembly to engage the extension assembly and couple the chain to the extension assembly to move the extension assembly along the extension track; and the motor is operable to move the chain in a second direction that moves the second engaging extension toward the retraction assembly to engage the retraction assembly and couple the chain to the retraction assembly to move the retraction assembly along the retraction track.

2. The roller blind assembly of claim 1, further comprising a first limit switch and a second limit switch, wherein:

the first limit switch is attached to the frame and positioned adjacent to the extension track to be activated by the extension assembly when the extension assembly has been moved along the extension track to fully extend the roller blind sheet across the frame, wherein the first limit switch when activated causes the motor to stop moving the extension assembly along the extension track; and the second limit switch is attached to the frame and positioned adjacent to the extension track to be activated by the extension assembly when the extension assembly has been moved along the extension track by the roller blind sheet being fully retracted from across the frame, wherein the second limit switch when activated causes the motor to stop moving the retraction assembly along the retraction track.

3. The roller blind assembly of claim 1, wherein the roller blind sheet further comprises:

an elongated sleeve adjacent to the top edge of the roller blind sheet; and an elongated piece of material held within the sleeve, wherein the piece of material is configured to provide horizontal support to the roller blind sheet when extended from the tube of the roller tube assembly and allow the roller blind sheet to roll up around the tube when the roller blind sheet is retracted.

4. The roller blind assembly of claim 1, wherein the roller blind sheet further comprises an elongated sleeve adjacent to the second side edge of the roller blind sheet; and the extension assembly further comprises an elongated finger extending upward from the extension assembly to be inserted in the sleeve to connect the extension assembly to the roller blind sheet.

5. The roller blind assembly of claim 1, further comprising a motor controller attached to the frame, wherein the motor controller is connected to the motor to control the operation of the motor to extend or retract the roller blind sheet.

6. The roller blind assembly of claim 1, further comprising a power supply shelf attached to the frame and configured to support a power supply of the roller blind assembly that powers the motor.

7. The roller blind assembly of claim 1, wherein the tether comprises a string, a cord, a wire, or a cable.

8. The roller blind assembly of claim 1, wherein the roller tube assembly further comprises a roller sheet guide attached to the first side of the frame adjacent to the tube of the roller tube assembly at a mid-length of the tube, and comprising a curved portion that partially extends around and adjacent to the tube so that the roller sheet guide guides and maintains the roller blind sheet firmly around the tube as the roller blind sheet is retracted and rolled up around the tube.

9. The roller blind assembly of claim 1, wherein the roller tube assembly, the chain assembly, the track assembly, and the motor assembly are attached to the frame within an interior of the frame, wherein the interior of the frame extends between the first side, the bottom side, and the second side of the frame.

10. The roller blind assembly of claim 1, further comprising an outer frame comprising an outer first side, an outer second side, an outer top side, and an outer bottom side, wherein:

the outer first side, the outer second side, the outer top side, and the outer bottom side are connected together respectively to form a modified rectangular shape so that the outer first side extends parallel and congruent in length with the first side of the frame, the outer second side extends parallel and congruent in length with the second side of the frame, and the outer bottom side extends parallel and congruent in length with the bottom side of the frame;

the outer frame is attached to the frame so that the outer first side is adjacent to the first side of the frame, the outer second side is adjacent to the second side of the frame, and the outer bottom side is adjacent to the bottom side of the frame; and the outer frame at least partially conceals the other components of the roller blind assembly that are attached or adjacent to the frame when the roller blind assembly is viewed toward the direction in which the outer frame is attached to the frame.

11. A method of using a roller blind assembly for covering the opening of a window having a modified rectangular shape wherein a top side of the window extends diagonally downward from a first side of the window to a second side of the window so that the top side of the window is non-perpendicular to the first side of the window and the second side of the window and is non-parallel to a bottom side of the window, the roller blind assembly comprising:

a frame comprising a first side, a second side, and a bottom side, wherein:

the first side of the frame extends vertically between a first side bottom end and a first side top end;

the second side of the frame extends vertically between a second side bottom end and a second side top end;

the bottom side of the frame extends horizontally between and is connected respectively to the first side bottom end and the second side bottom end;

the first side of the frame is longer than the second side of the frame; and the shape of the frame defined by the first side of the frame, the second side of the frame, and the bottom side of the frame corresponds to the modified rectangular shape of the window so that the frame can fully fit within or adjacent to the perimeter of the window by the first side of the frame extending parallel to the first side of the window, the second side of the frame extending parallel to the second side of the window, and the bottom side of the frame extending parallel to the bottom side of the window;

a roller tube assembly attached to the frame and comprising a cylindrical tube extending vertically adjacent to the first side of the frame and rotatably attached to the frame so that the tube is rotatable about a longitudinal center of the tube;

a roller blind sheet comprising a top edge, a bottom edge, a first side edge, and a second side edge that define a shape of the roller blind sheet that corresponds to the modified rectangular shape of the window so that the roller blind sheet covers the opening of the window, wherein:

the first side edge of the roller blind sheet is longer than the second side edge;

the first side edge of the roller blind sheet is attached to the tube of the roller tube assembly so that the roller blind sheet can be rolled up around the tube and can be unrolled and extended from the tube to respectively uncover and cover the opening of the window; and the top edge of the roller blind sheet is configured to horizontally support the roller blind sheet when extended from the tube and to allow the roller blind sheet to roll up around the tube when retracted;

a chain assembly attached to the frame and comprising a chain extending in and moveable along a horizontal loop between the first side of the frame and the second side of the frame adjacent to the bottom side of the frame, wherein the chain comprises a first engaging extension and a second engaging extension that each comprise a rectangular shaped plate attached to and extending from the chain;

a track assembly attached to the frame and comprising an extension track and a retraction track, wherein the extension track and the retraction track each comprise a pair of rods extending between the first side and the second side of the frame;

an extension assembly comprising a rectangular prism shaped body having a pair of openings extending therethrough and a rod extending therefrom, wherein:

the extension assembly is moveably connected to the extension track through the openings of the extension assembly so that the extension assembly can move along the extension track between the first side of the frame and the second side of the frame;

the extension assembly is engageably coupleable to the chain by the body of the extension assembly so that a movement of the first engaging extension toward the extension assembly by a movement of the chain causes the first engaging extension to engage the body of the extension assembly and couple the chain to the extension assembly to move the extension assembly along the extension track; and the extension assembly is connected to the roller blind sheet by the rod of the extension assembly adjacent to the second side edge of the roller blind sheet so that a movement of the extension assembly along the extension track by the chain causes an unrolling and extending of the roller blind sheet from the tube and horizontally across the frame;

a retraction assembly comprising a rectangular prism shaped body having a pair of openings extending therethrough, wherein:

the retraction assembly is moveably connected to the retraction track through the openings of the retraction assembly so that the retraction assembly can move along the retraction track between the first side and the second side of the frame;

the retraction assembly is engageably coupleable to the chain by the body of the retraction assembly so that a movement of the second engaging extension toward the retraction assembly by a movement of the chain causes the second engaging extension to engage the body of the retraction assembly and couple the chain to the retraction assembly to move the retraction assembly along the retraction track; and the retraction assembly is coupled to the tube of the roller tube assembly by a tether that is connected to the body of the retraction assembly and to the tube, wherein the tether is configured to rolls up around the tube as the roller blind sheet is unrolled and extended from the tube and unroll and extend from the tube by a movement of the retraction assembly along the retraction track by the chain, and wherein the roller blind sheet is configured to retract and roll up around the tube as the tether is unrolled and extended from the tube by a movement of the retraction assembly along the retraction track by the chain; and a motor assembly attached to the frame and comprising a motor, wherein:

the motor is coupled to the chain so that the motor can cause the chain to move along the horizontal loop;

the motor is operable to move the chain in a first direction that moves the first engaging extension toward the extension assembly to engage the extension assembly and couple the chain to the extension assembly to move the extension assembly along the extension track; and the motor is operable to move the chain in a second direction that moves the second engaging extension toward the retraction assembly to engage the retraction assembly and couple the chain to the retraction assembly to move the retraction assembly along the retraction track;

the method comprises:

installing the roller blind assembly to the window by attaching the frame of the roller blind assembly to the window whereby the first side of the frame is adjacent to the first side of the window, the second side of the frame is adjacent to the second side of the window, and the bottom side of the frame is adjacent to the bottom side of the window.

12. The method of claim 11, further comprising covering the opening of the window with the roller blind sheet by operating the motor to move the chain in the first direction and thereby:

moving the first engaging extension toward the extension assembly;

engaging the extension assembly by the first engaging extension;

coupling the chain to the extension assembly;

moving the extension assembly along the extension track; and unrolling and extending the roller blind sheet from the tube and horizontally across the opening of the window, thereby covering the opening of the window;

wherein the tether is rolled up around the tube as the roller blind sheet is unrolled and extended from the tube.

13. The method of claim 12, further comprising uncovering the roller blind sheet from the opening of the window by operating the motor to move the chain in the second direction and thereby:

moving the second engaging extension toward the retraction assembly;

engaging the retraction assembly by the second engaging extension;

coupling the chain to the retraction assembly;

moving the retraction assembly along the retraction track;

unrolling and extending the tether from the tube by the retraction assembly; and retracting and rolling up the roller blind sheet around the tube by the tether unrolling from the tube, thereby uncovering the roller blind sheet from the opening of the window.

* * * * *